US008740759B2

(12) United States Patent
Knight

(10) Patent No.: US 8,740,759 B2
(45) Date of Patent: Jun. 3, 2014

(54) MARTIAL ARTS TRAINING DEVICE

(76) Inventor: Tommy Jubei Knight, Tampa, FL (US)

( * ) Notice: Subject to any disclaimer, the term of this patent is extended or adjusted under 35 U.S.C. 154(b) by 393 days.

(21) Appl. No.: 13/305,197

(22) Filed: Nov. 28, 2011

(65) Prior Publication Data

US 2013/0137554 A1 May 30, 2013

(51) Int. Cl.
*A63B 69/34* (2006.01)

(52) U.S. Cl.
USPC ..... 482/85

(58) Field of Classification Search
CPC ..... A63B 69/20–69/345
USPC ..... 482/83–90; 473/441, 444; 446/325–326, 390
See application file for complete search history.

(56) References Cited

U.S. PATENT DOCUMENTS

| | | | | |
|---|---|---|---|---|
| 1,481,594 | A * | 1/1924 | Fitzgerald | 482/85 |
| 2,909,370 | A | 10/1959 | Fortney | |
| 4,088,315 | A | 5/1978 | Schemmel | |
| 5,700,230 | A | 12/1997 | Cardona | |
| 6,155,960 | A | 12/2000 | Roberts et al. | |
| 2006/0019803 | A1 * | 1/2006 | Giaquinta et al. | 482/83 |
| 2011/0172065 | A1 | 7/2011 | Bayne | |
| 2011/0256990 | A1 | 10/2011 | Machado et al. | |
| 2011/0281695 | A1 * | 11/2011 | Machado et al. | 482/83 |

OTHER PUBLICATIONS

Title MMA ground and pound training dummy, www.titlemma.com/p_GPTD.aspx , Nov. 8, 2011.
UFC pro grappling dummy, www.titlemma.com/p_UFGD+100+BK.aspx , Nov. 8, 2011.
Title freestyle throwing and grappling dummy, www.titlemma.com/p_MMTGD+70.aspx , Nov. 8, 2011.
Grapple Man, www.dummiesunlimited.com/grappleman.htm , Nov. 8, 2011.
Bob, www.dummiesunlimited.com/products/martialarts/bob.html, Nov. 8, 2011.
Bubba® the ultimate grappling dummy, www.bubbadummy.com , Nov. 8, 2011.
Submission Master® Grappling Dummy, www.grapplingdummy.net/?gclid=CPKz85-8qKwCFQtU7AodDT0GEw, Nov. 8, 2011.
How to Make an El Jefe Grappling Dummy, www.thelivingexample.com/eljefe.html, Nov. 8, 2011.

* cited by examiner

*Primary Examiner* — Loan H Thanh
*Assistant Examiner* — Jennifer M Deichl
(74) *Attorney, Agent, or Firm* — Lonnie R Drayer

(57) ABSTRACT

A martial arts training device has a base assembly fixed to a torso assembly in a manner that allows the torso assembly to pivot with respect to the base assembly. The base assembly includes a container with a convex shaped bottom that contains ballast with a greater concentration of weight located at a front portion of the container. The base assembly includes a base cushion member with leg portions. The distribution of weight in the container and the weight of the leg portions causes the martial arts training device to rebound to an upright state when the device is displaced from an upright state during use of the device during training.

20 Claims, 26 Drawing Sheets

26
78
40
38
39
39
36

FIG. 29
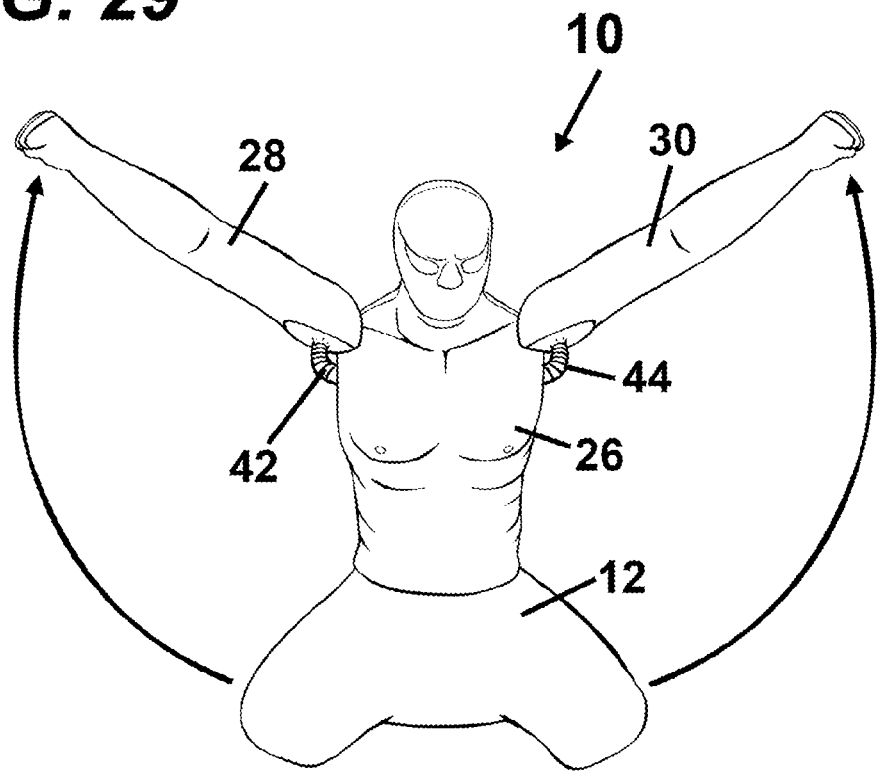
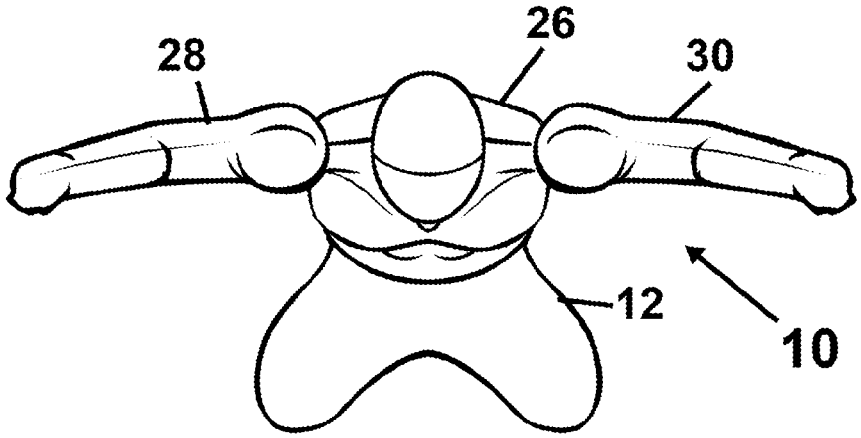
FIG. 30

FIG. 33
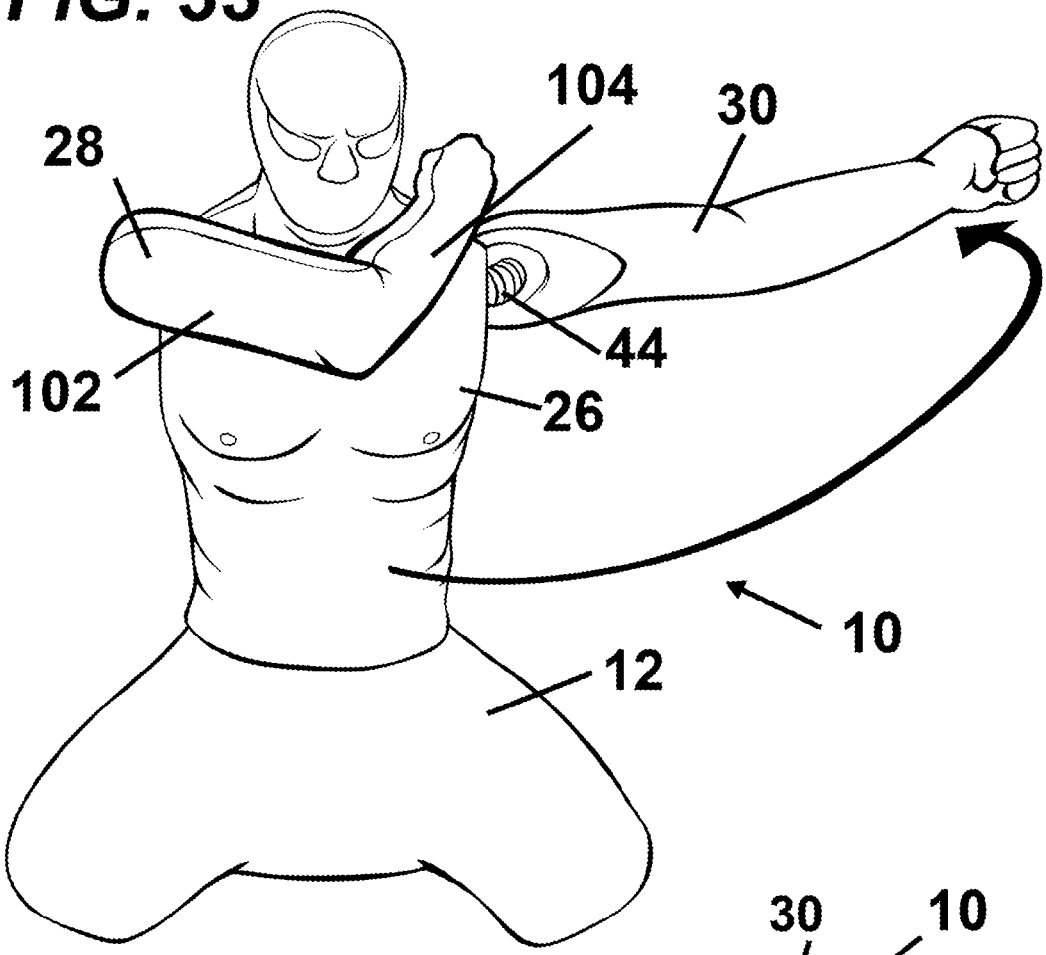
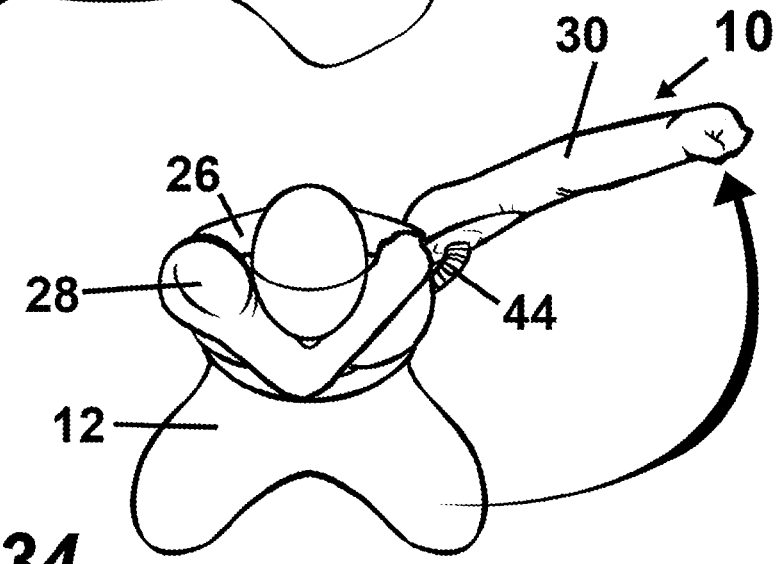
FIG. 34

MARTIAL ARTS TRAINING DEVICE

FIELD OF THE INVENTION

The present invention relates to a martial arts training device of a type commonly referred to as a grappling dummy used in practicing mixed martial arts.

BACKGROUND OF THE INVENTION

Mixed martial arts (MMA) is a full contact combat sport that allows the use of both striking and grappling techniques, both standing and on the ground, including boxing, wrestling, Brazilian Jiu-jitsu, muay That, kickboxing, karate, judo and other styles. A common practice has been to practice self defense techniques with a training partner, using either no body contact at all or some degree of contact, but with a range of padding accessories worn by both partners in order to protect both partners against injury. A person involved in MMA may not always have a willing and capable partner available when the person wants to practice. Further, it may be preferable to teach and practice many MMA skills without using a human opponent.

A type of device that can be used in the teaching and practice of MMA is commonly referred to as a grappling dummy which can be man-shaped, bag-like or have a variety of other shapes. A grappling dummy serves as a mock opponent for a user to learn MMA skills and to practice his or her exercise routine. Having a dummy as a martial arts training device allows an MMA student or participant to practice skills such as kicks, punches and so forth at his or her convenience and as often as desired.

Discussion of the Prior Art

Martial arts training devices are widely marketed using the internet. One example is http//www.titlemma.com/p_GPT-D.aspx where Holiday offers a "Title MMA ground and pound training dummy" that can be used for grappling and other MMA training activities. At http//www.titlemma.com/p_UFGD+100+BK.aspx Holiday also offers a "UFC pro grappling dummy". These two products are exemplary of bag type dummies that do not have any articulating features and have no capacity to return to an upright orientation spontaneously when displaced from an upright orientation during a training activity. At www.titlemma.com/p_MMTGD+70.aspx Holiday also offers a "Title freestyle throwing and grappling dummy" having an appearance emulating a human body, but does not appear to be provided with a means for the dummy assuming an upright position without some additional device and therefore no capacity to return to an upright orientation spontaneously when displaced from an upright orientation during a training activity.

Another example of a product marketed using the internet is www.dummiesunlimited.com/grappleman.htm where Dummies Unlimited Inc. offers a device called Grapple Man which is described as a life size training dummy made of "a unique polyurethane compound molded over urethane foam" with joints held together by steel cables allowing the joint "to articulate in a manner similar to that of a real person." At http//www.dummiesunlimited.com/products/martialarts/bob.html Dummies Unlimited Inc. offers another martial arts training device called "Bob" the sparring partner. According to this web page "Bob" is made of a "unique soft polyurethane compound molded over urethane foam." "Bob" has an upper torso figure mounted on an adjustable pole that is fixed to a base that can be filled with sand as ballast.

Another example of a product marketed using the internet is www.bubbadummy.com/ where Bubba® Dummy.com offers "Bubba® the ultimate grappling dummy" which "has realistic, flexible joints and a durable body". Per this web page Bubba® is the subject of U.S. Pat. No. 6,139,328 which does not indicate that Bubba® has a capacity to return to an upright orientation spontaneously when displaced from an upright orientation during a training activity.

Yet another example of a product marketed using the internet is www.grapplingdummy.net/?gclid=CPKz85-8qKwCFQtU7AodDTOGEw where the Submission Master® Grappling Dummy is offered for sale. The dummy pictured on this web page emulates the shape of a human body with an emphasis in the text of a feature that the legs of the dummy will not become straight but will always remain "up" which seems to mean that the "thigh" will remain substantially perpendicular to the abdomen with the lower leg bent backwards from the knee.

At www.thelivingexample.com/eljefe.html there is a publication entitled "How To Make An El Jefe Grappling Dummy". The grappling dummy taught in this publication does not appear to be provided with a means for the dummy assuming an upright position without some additional device and therefore no capacity to return to an upright orientation spontaneously when displaced from an upright orientation during a training activity.

U.S. Pat. No. 2,909,370 teaches a boxing dummy for use in the training of boxers. The dummy has a torso, legs, arms and head built upon a framework and includes a base adapted to rest upon a floor. U.S. Pat. No. 4,088,315 teaches a self defense training device that is a life-like articulated training dummy supported in an upright position on a post. U.S. Pat. No. 5,700,230 teaches a martial arts training device which includes a movable mannequin having a human appearance mounted on a post supported by a base. None of these publications teach a dummy provided with a capacity to return to an upright orientation spontaneously when the entire device is displaced from an upright orientation during a training activity.

U.S. Pat. No. 6,155,960 teaches a training dummy in human form that includes a torso having at least one upper arm fastened to the torso at least one upper arm attachment point and capable of rotating about an X axis and pivoting about the X, Y & Z axes of an upper arm attachment point. A returning means is securely attached to the dummy for returning the upper arm and torso back to their initial positions after having a twisting, restraining, or striking force exerted upon the dummy. A counterbalancing means is attached to the torso for counterbalancing a force applied to the dummy. The dummy is suspended from the counterbalancing means which tends to return the dummy to an upright position if the dummy is taken down to the floor. This publication does not teach a dummy provided with a capacity to return to an upright orientation spontaneously when the entire device is displaced from an upright orientation during a training activity.

US 2011/0256990 A1 teaches a training dummy that includes a base, a column, a tensioning mechanism and a dummy. The base rests on the ground and the column is pivotally coupled to the base by the tensioning mechanism. A torso of the dummy is coupled to the column. This publication does not teach a dummy provided with a capacity to return to an upright orientation spontaneously when the entire device is displaced from an upright orientation during a training activity.

US 2011/0172065 A1 teaches a strength training dummy for use in training to perform a guillotine choke. The dummy is designed to be attached to a cable of a weight training machine, and is not provided with a means for the dummy assuming an upright position and returning to an upright orientation spontaneously when displaced from an upright orientation during a training activity.

SUMMARY OF THE INVENTION

There is provided in accordance with the present invention a martial arts training device of a type commonly referred to as a grappling dummy, the martial arts training device having a base assembly fixed to a torso assembly in a manner that allows the torso assembly to pivot with respect to the base assembly. The base assembly includes a container with a convex shaped bottom that contains ballast with a greater concentration of weight of ballast located at a front portion of the container. The base assembly includes a base cushion member with leg portions. The distribution of weight in the container and the weight of the leg portions causes the container to tilt forward when the martial arts training device is at rest in an upright state, and causes the martial arts training device to rebound to an upright state when the device is displaced from an upright state during use of the device during training. The torso assembly may include arms that are attached to a torso such that the arms may be pivoted with respect to the torso, and each arm may be provided with a device that allows the arm to bend in a way that emulates the bending of a human arm at an elbow.

BRIEF DESCRIPTION OF THE DRAWINGS

FIGS. 29 and 30 are schematic representations of a range of motion of lateral elevation of the arms of the martial arts training device.

FIGS. 33 and 34 are schematic representations of a range of motion of the arms of the martial arts training device across the chest portion of the torso both with an arm remaining straight and with an arm bent emulating the manner in which a human arm bends at an elbow.

DETAILED DESCRIPTION OF THE INVENTION

Figure 1:
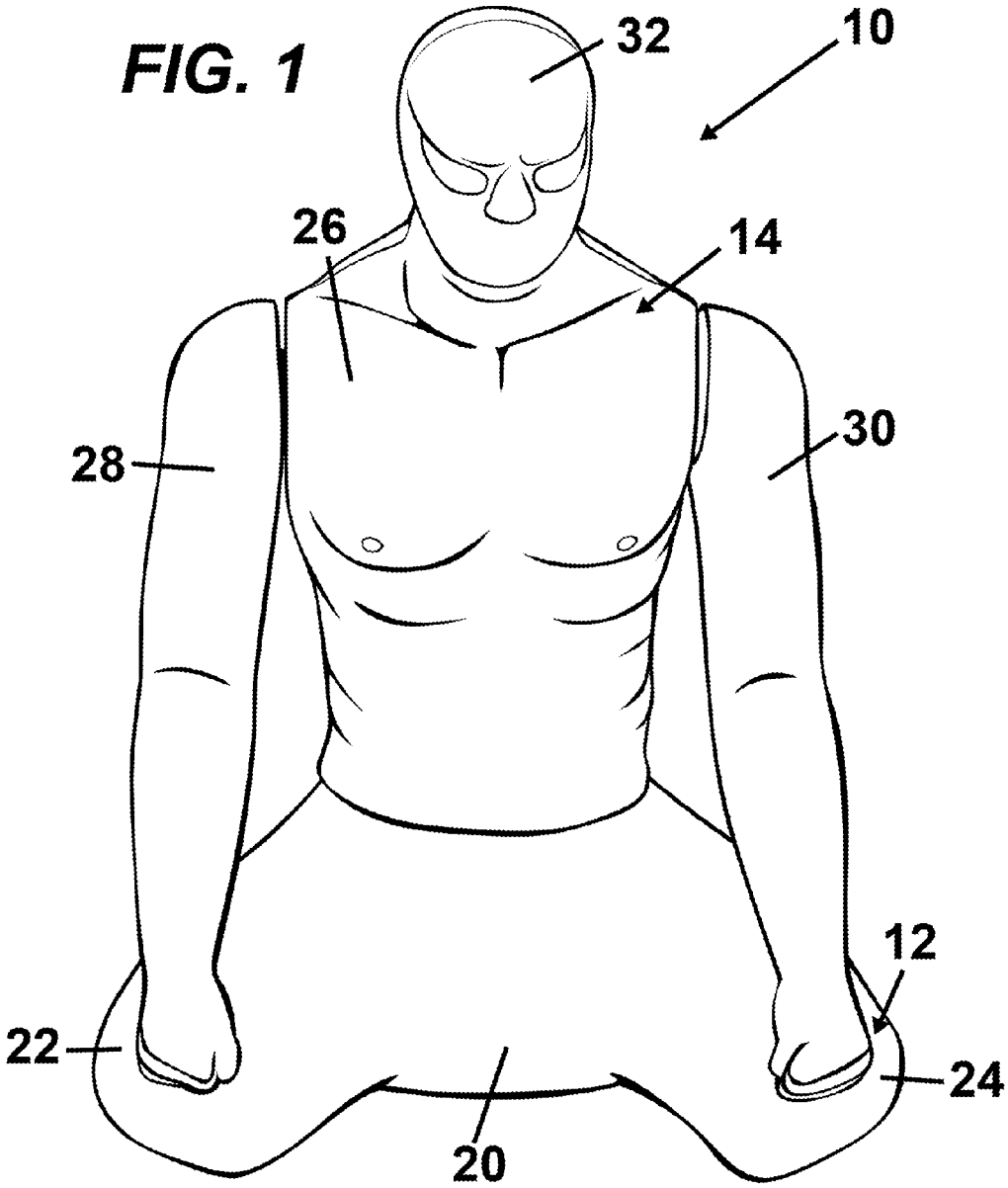
FIG. 1 is a front pictorial view of a martial arts training device, of a type commonly referred to as a grappling dummy, according to the present invention.
Figure 2:
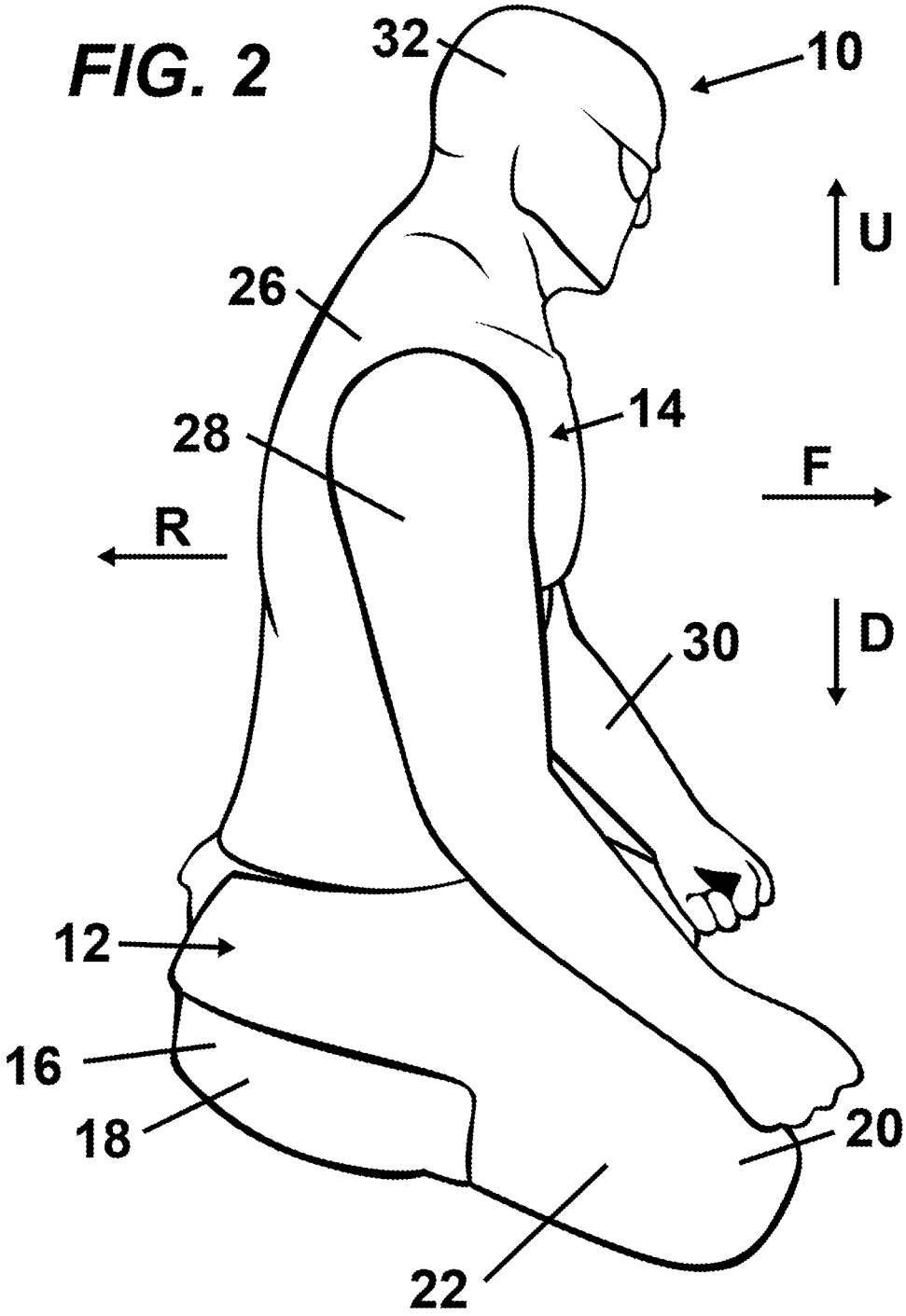
FIG. 2 is a side pictorial view of the martial arts training device.
Figure 3:
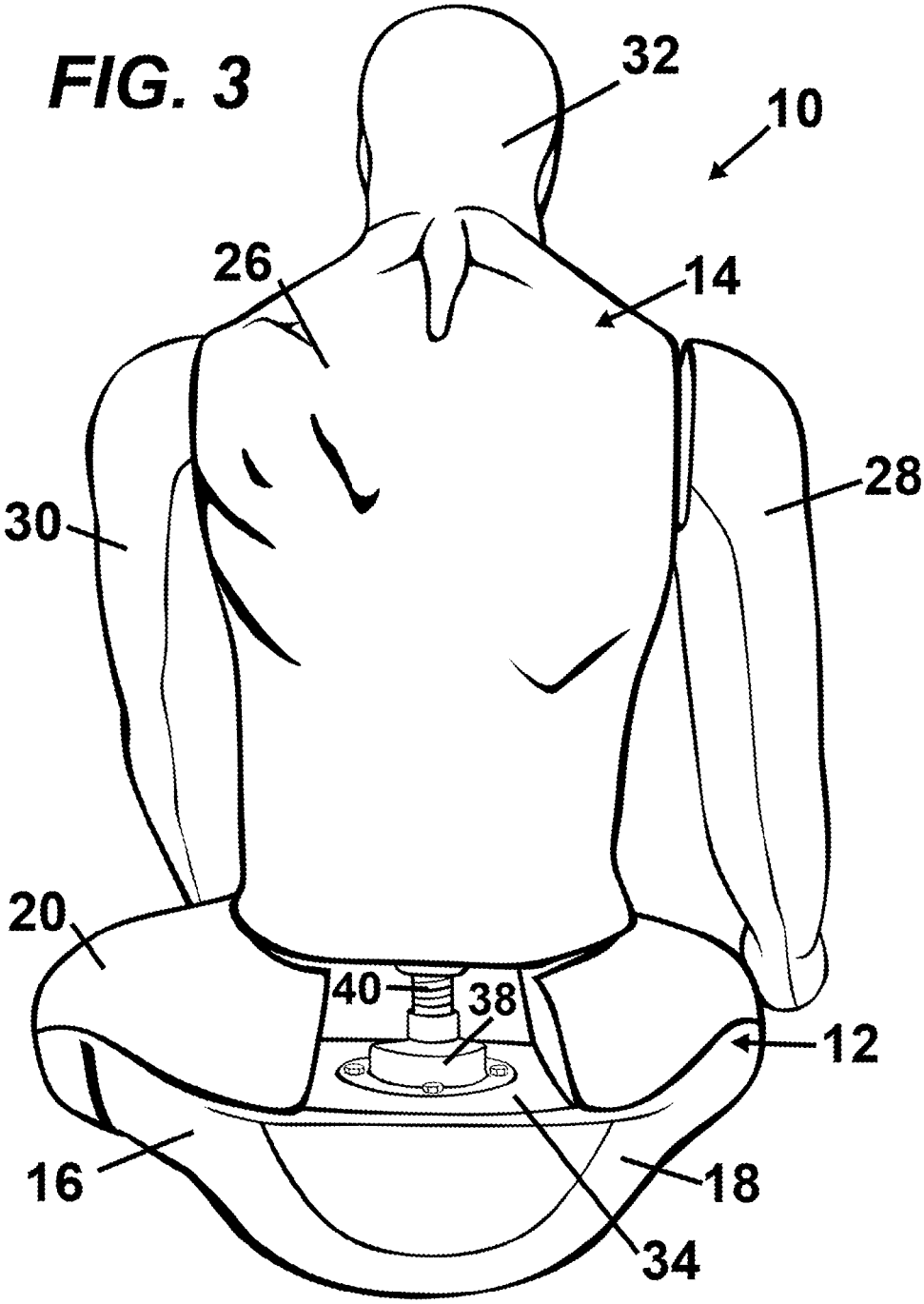
FIG. 3 is a rear pictorial view of the martial arts training device.

FIGS. 1-3 show front, side and rear pictorial views respectively of a martial arts training device 10 in accordance with an exemplary embodiment of the present invention. The martial arts training device 10 is a type commonly referred to as a grappling dummy used in practicing mixed martial arts. The terms martial arts training device and grappling dummy may be used interchangeably in the context of the description and claims of the present document. The martial arts training device 10 comprises a base assembly 12 and a torso assembly 14. As shown, the grappling dummy emulates a sitting person.

The base assembly includes a base 16 and a base cushion member 20. The base includes a container 18 with a convex bottom as best seen in FIG. 3. The base cushion member 20 is formed of a foam substance and is fixed to the container 18 in a manner that will be explained later in this document. The base cushion member 20 includes leg portions 22, 24 that extend forward from the container 18.

As used herein and in the claims terms such as "top", "above", "higher" and "above", as indicated by arrow U in FIG. 2, refer to directions going from a surface upon which a grappling dummy of the present invention is resting when the grappling dummy is in an upright position towards a vertically highest part of the grappling dummy. Terms such as "bottom", "below", "lower" and "below", as indicated by arrow D in FIG. 2, refer to directions going towards a surface upon which a grappling dummy of the invention is resting when the grappling dummy is in an upright position. As used herein and in the claims terms such as "front" and "forward", as indicated by arrow F in FIG. 2, refer to directions going forwards from a surface of the grappling dummy that corresponds to the chest of the torso of the grappling dummy when the grappling dummy is resting on a flat surface in an upright position. As used herein and in the claims terms such as "back" and "rearward", as indicated by arrow R in FIG. 2, refer to directions going rearwards from a surface of a component of a grappling dummy that corresponds to the back of the torso of the grappling dummy when the grappling dummy is resting on a flat surface in an upright position.

The torso assembly 14 includes a torso 26 that is formed of a foam substance and a device 40, as shown in FIG. 2, that allows the torso assembly 14 to be pivoted with respect to the base assembly 12. A mounting fixture 38 is fixed to the device that allows the torso assembly to be pivoted with respect to the base assembly, and the mounting fixture 38 of the torso assembly is attached to a mounting fixture that is fixed to and located at the top of the cover 34 of the container 18 of the base assembly in a manner that will be explained later in this document. The torso assembly 14 further comprises a pair of arms 28, 30 fixed to the torso 26, each arm being formed of a foam substance. Preferably the torso 26 includes a head 32 that emulates a human head located the top of the torso.

Figure 4:
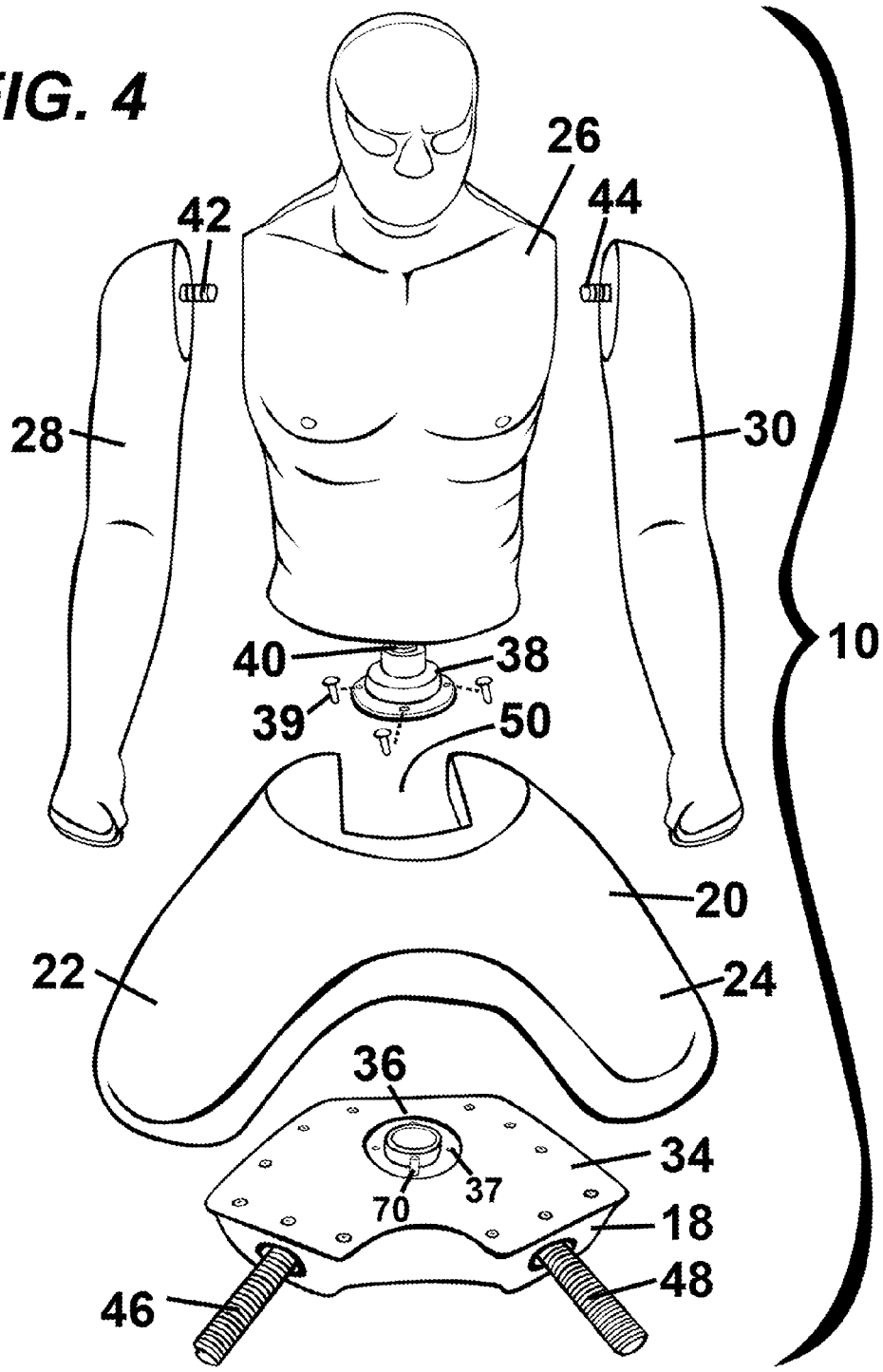
FIG. 4 is an exploded view of the martial arts training device.

Referring next to FIG. 4 there is shown an exploded view of the martial arts training device 10. Starting from the bottom of this figure there is shown a front perspective view of the container 18 that is a base that supports the grappling dummy. Two springs 46, 48 extend forward from a front surface of the container and are used to reinforce the leg portions 22, 24 of the base cushion member 20 in a manner that will be explained later in this document. A cover 34 is fixed to an upper portion of the container 18 and a mounting fixture 36 is integral with or attached to the cover. In a prototype the mounting fixture 36 is molded integral with the cover and has threaded nuts molded with the cover and aligned with holes 37 in the mounting fixture. The holes 37 and a guiding stud 70 that is secured to the cover during a molding procedure are used in fixing the torso assembly to the base assembly. The base cushion member 20 is provided with a notch 50 that allows the mounting fixture 36 of the base assembly to remain exposed and available for fixing the torso assembly to the base assembly, as shown for example in FIG. 3.

The torso 26 of the grappling dummy is provided with a device 40, such as a coil sprig, that allows the torso assembly to be pivoted with respect to the base assembly. A mounting fixture 38 is fixed to the device 40. The guiding stud 70 of the mounting fixture 36 of the base assembly engages a hole in a flange of the mounting fixture 38 of the torso assembly to aid in correct alignment of the two mounting fixtures 36, 38 to aid in joining the torso assembly with the base assembly. Threaded fasteners 39 extend through holes in a flange of the mounting fixture 38 of the torso assembly then engage the holes 37 in a flange of the mounting fixture 36 of the base assembly to secure the two mounting fixtures 36, 38 to one another in a threaded manner. A nut, not shown, is threaded onto the mounting stud 70 to further aid in securing the two mounting fixtures to one another. Two arms 28, 30 are fixed to the torso 26. Each arm is fixed to the torso by a device 42, 44, such as a coil spring, that allows the arm to be pivoted with respect to the torso in a manner that will be explained later in this document.

Figure 5:
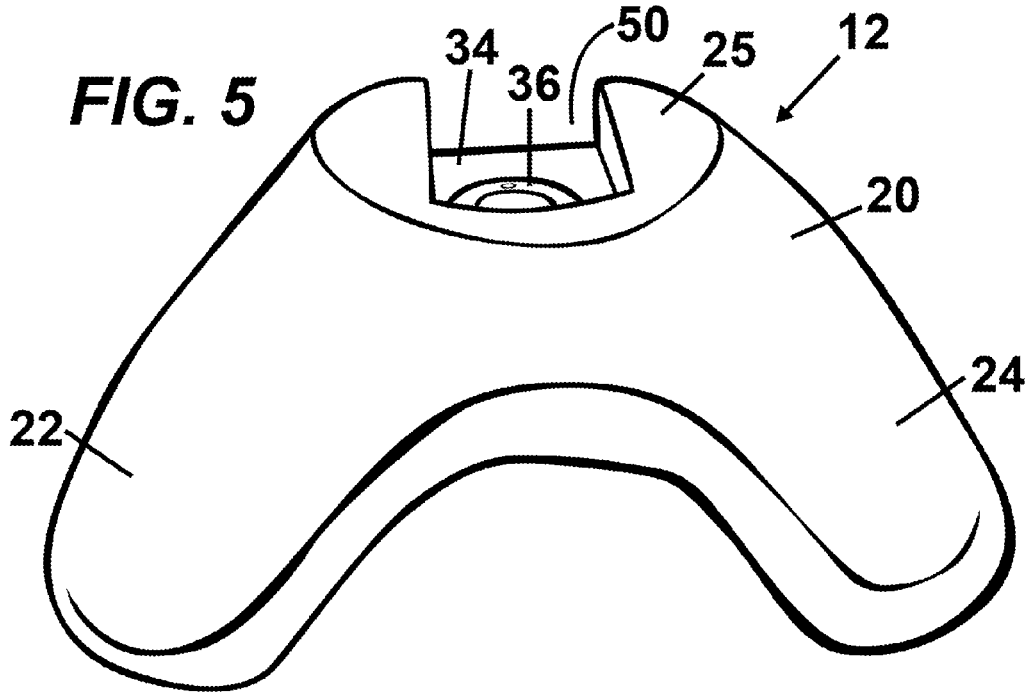
FIG. 5 is a perspective view from the front of a base assembly of the martial arts training device.
Figure 6:
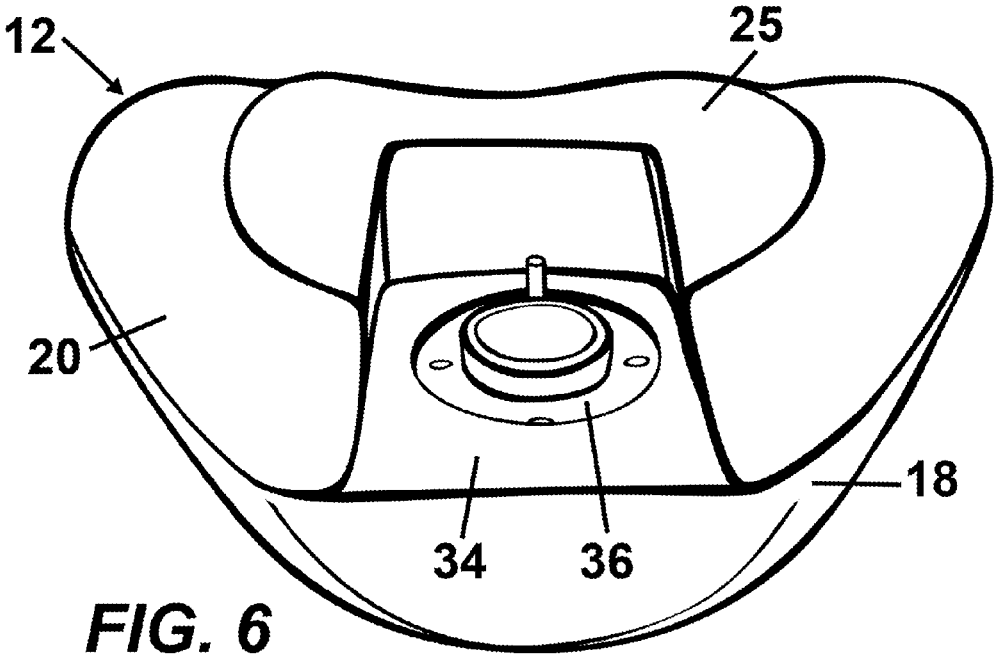
FIG. 6 is a perspective view from the rear of the base assembly of the martial arts training device.
Figure 7:
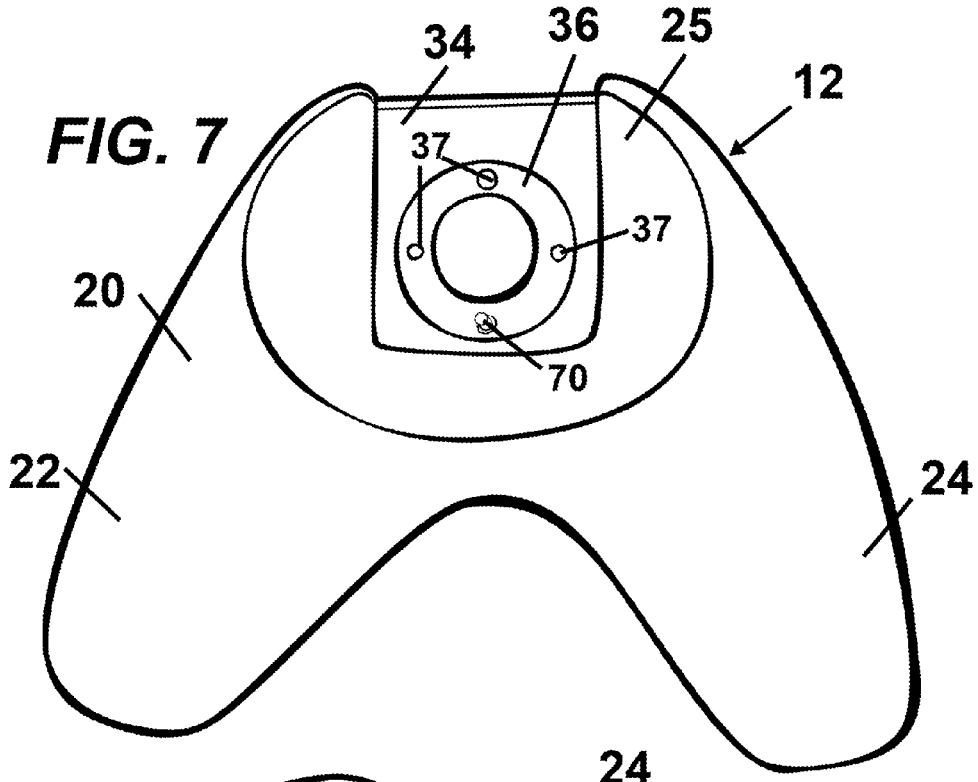
FIG. 7 is a top view of the base assembly of the martial arts training device.
Figure 8:
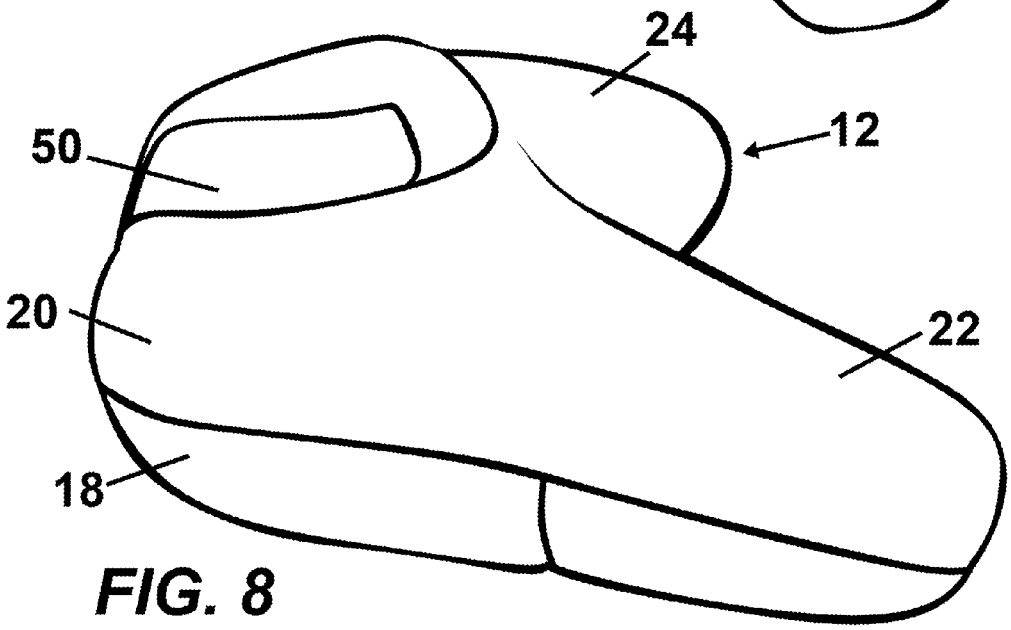
FIG. 8 is another perspective view of the base assembly of the martial arts training device.
Figure 9:
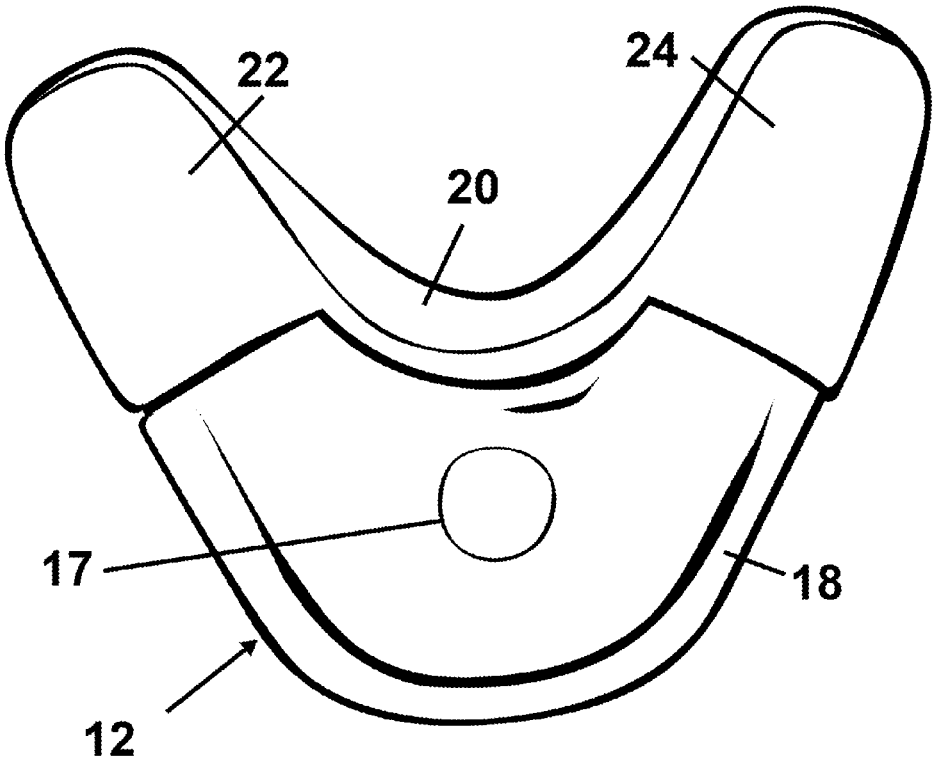
FIG. 9 is a bottom view of the base assembly.

The base assembly 12 is shown in: a perspective view from the front in FIG. 5; a perspective view from the rear in FIG. 6; a top view in FIG. 7; a perspective view in FIG. 8; and a bottom view in FIG. 9. The location of a portion of the base cushion member 20 on the top of the cover 34 of the container 18 is shown in FIGS. 5, 6, 7 and 8. The manner in which the leg portions 22, 24 of the base cushion member 20 extend forward from the container 18 is shown in FIGS. 8 and 9. The convex bottom of the container 18 is shown in FIGS. 6, 8 and 9. A circular shaped flat portion 17 of the convex bottom of the container is shown in FIG. 9. The manner in which the notch 50 in the base cushion member 20 leaves the mounting fixture 36 located on the cover 34 of the container exposed and available for mating with the mounting fixture of the torso assembly is shown in FIGS. 5, 6 and 7. The arrangement of the holes 37 and a guiding stud 70 of the mounting fixture 36 of the base assembly is shown in FIGS. 6 and 7.

Figure 10:
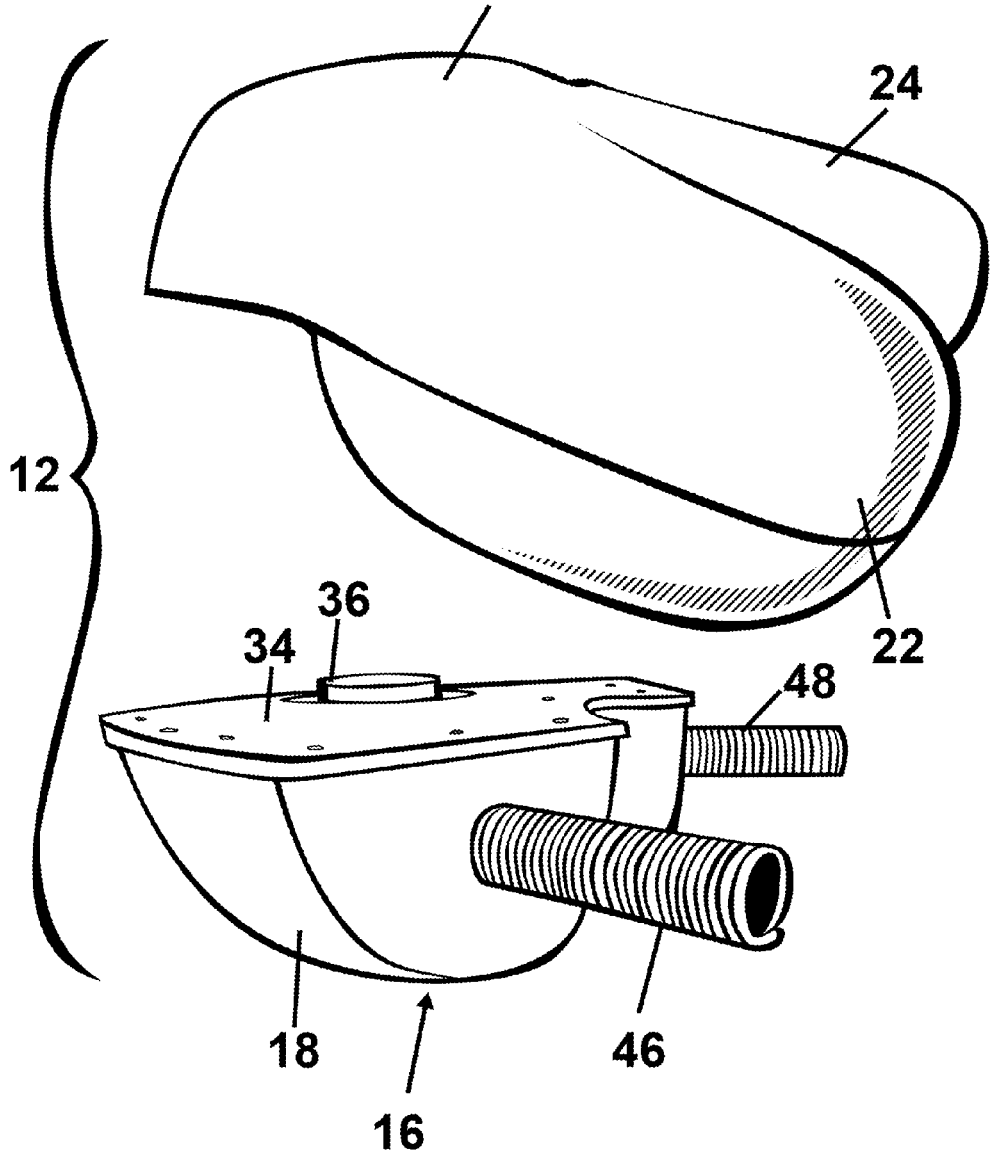
FIG. 10 is an exploded view of the base assembly.

FIG. 10 is an exploded view of the base assembly 12 which comprises the base 16 and the base cushion member 20. The base cushion member 20 with the two leg portions 22, 24 is shown positioned as it would be in the process of placing it on the cover 34 of the container 18 with two springs 46, 48 extending forward from the container. When the base cushion member is placed in its operative position on top of the container, as shown for example in FIGS. 6, 7, 8 and 20A, a bottom surface of the base cushion member is secured to the cover 34 of the container 18 by a suitable adhesive with the mounting fixture 36 remaining exposed.

Figure 11:
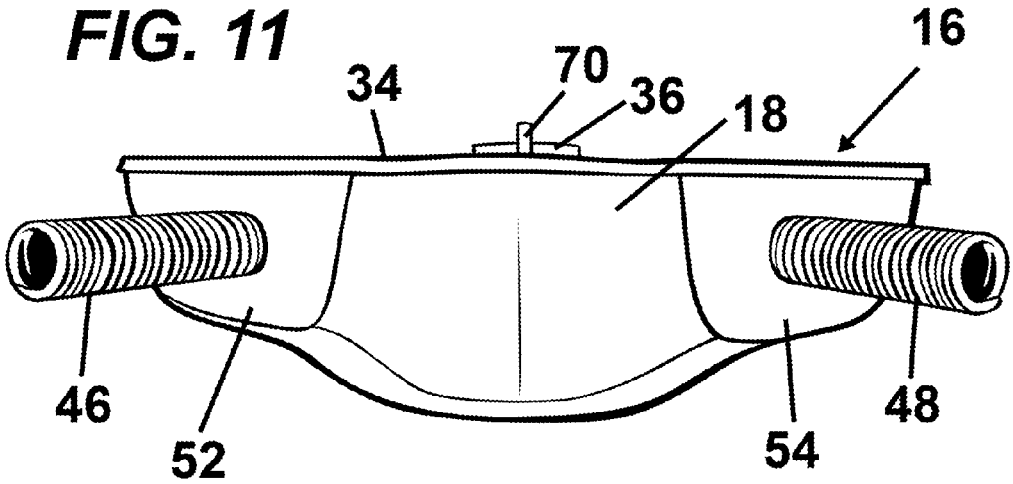
FIG. 11 is a front view of the base that is a component of the base assembly.
Figure 12:
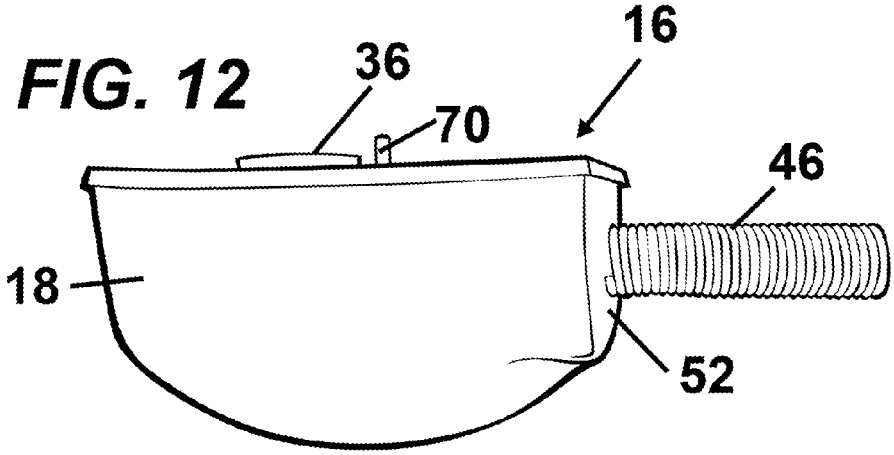
FIG. 12 is a side view of the base.

FIG. 11 is a front view of the base 16 and FIG. 12 is a side view of the base. It is understood that the base 16, which has several components, along with the base cushion member 20 comprise the base assembly 12. One component of the base 16 is the container 18, which has a convex bottom that includes a flat portion 17 as shown in FIG. 9. The container has forward facing walls 52, 54 from which springs 46, 58 extend forward to be received in wells 45, 47 in the leg portions of the base cushion member 20 as best understood by referring to FIGS. 20 and 20A. Another component of the base 16 is a cover 34 that is fixed to the container and a mounting fixture 36, with an associated guide stud 70, which is either molded as a part of the cover or is a separate component fixed to the cover.

Figure 13:
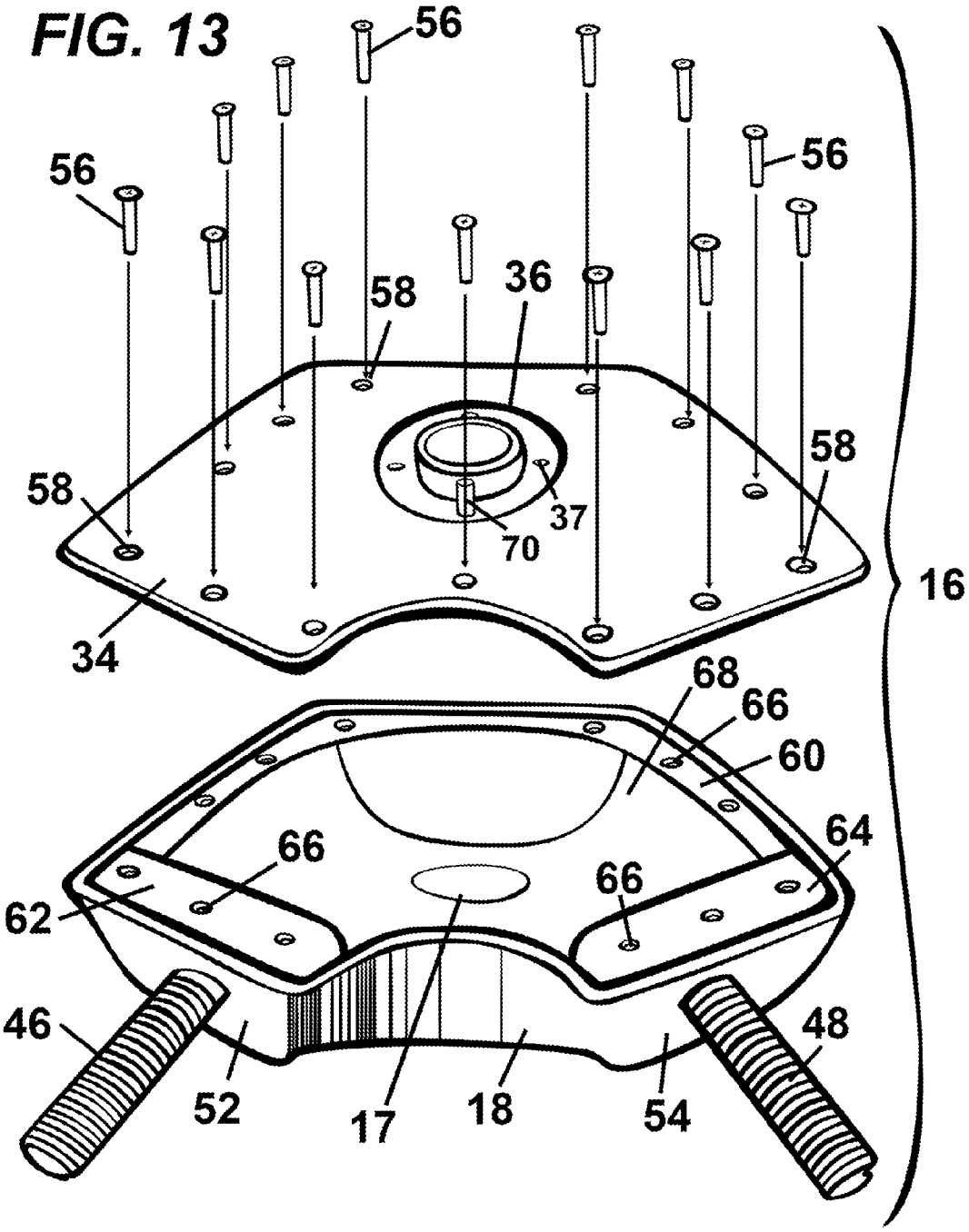
FIG. 13 is an exploded view of the base.

FIG. 13 is an exploded view of the base 16. The cover 34 is shown spaced apart from the container 18. The interior of the container normally contains at least one ballast component. The interior of the container is visible because at least one ballast component that is normally dispose in the container in an assembled martial arts training device has not yet been placed in the container. The circular shaped flat portion 17 of the convex bottom of the container is visible in FIG. 13. Heavy metal weights 63, 64 that are located at a front portion of the container cause weight of the ballast in the container to be biased towards the front of the container. A ledge 60 that is disposed at the inner side of the top of the container has a plurality of holes 66 therein and the metal weights 62, 64 each also have a plurality of holes therein. The cover 34 has a plurality of holes 58 therein that are aligned with the holes 66 in the ledge 60 and metal weights 62, 64 when the cover is assembled with the container with the cover adjacent the ledge and metal weights. Threaded fasteners 56 extend through the holes 58 in the cover and pass into the holes 66 in the ledge and metal weights to secure the cover to the container in a threaded manner.

Figure 14:
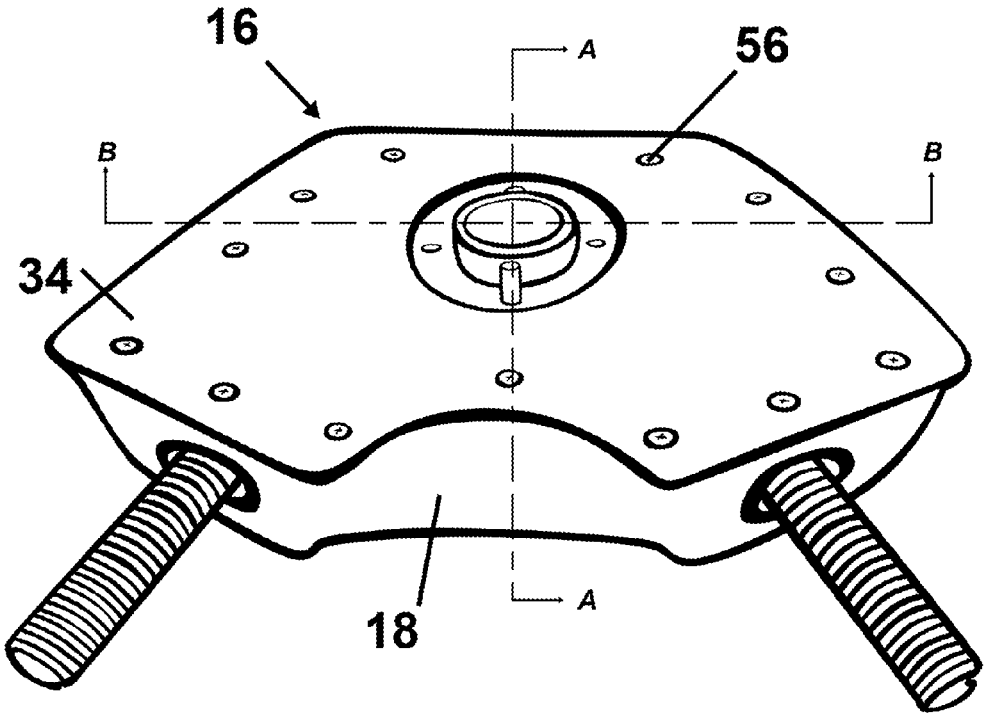
FIG. 14 is a perspective view from the front of the base.
Figure 15:
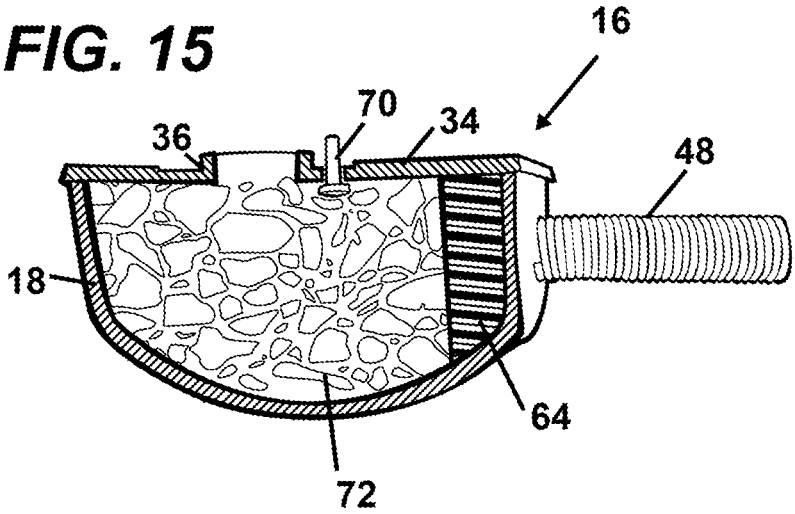
FIG. 15 is a cross section of the base taken along line A-A of FIG. 14.
Figure 16:
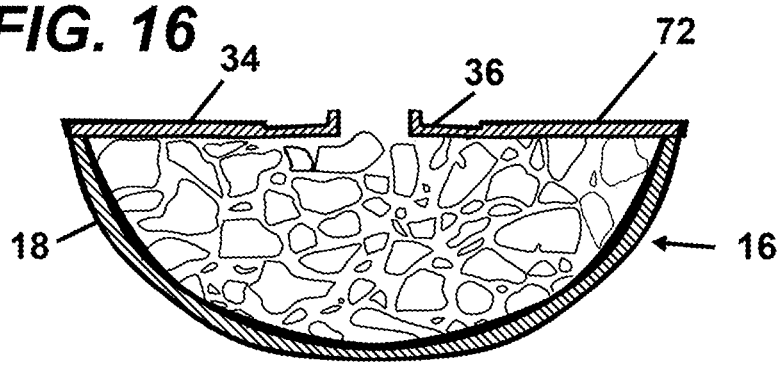
FIG. 16 is a cross section of the base taken along line B-B of FIG. 14.
Figure 17:
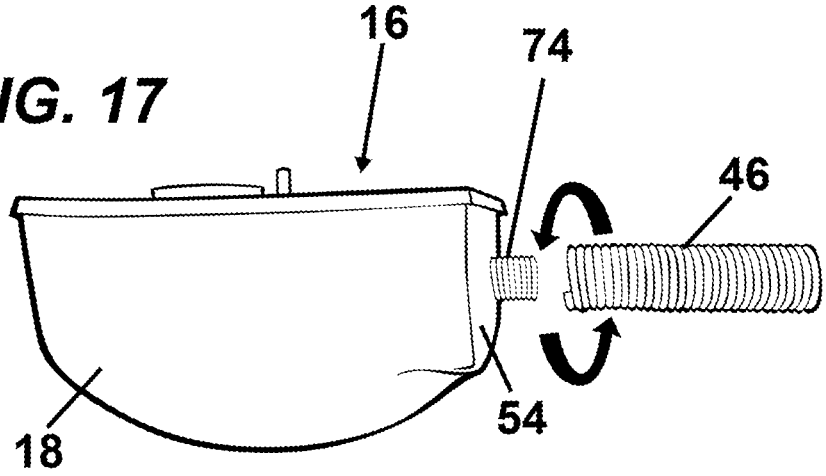
FIG. 17 is a side view of the base showing a spring detached from the base.

FIG. 14 is a perspective view from the front of the base 16. The threaded fasteners 56 are in their operative locations securing the cover 34 to the container 18 in a threaded manner. FIG. 15 is a cross section of the base taken along line A-A of FIG. 14, and FIG. 16 is a cross section of the base taken along line B-B of FIG. 14. In FIGS. 15 and 16 a ballast material in the form of pebbles, of a type commonly sold by suppliers of landscaping materials as "river rocks", have been placed in the interior of the container through an aperture in the mounting fixture 36 of the base assembly. To prevent the pebbles from moving about and making unwanted noise when the martial arts training device is being used, spaces between the pebbles are injected with foam. In a prototype the foam is a readily available insulation foam provided in an aerosol can. That is to say a portion of the pebbles were placed in the container, some foam was injected via the aperture in the mounting fixture, more pebbles were added, then more foam, and so forth until the interior of the container was packed with the pebbles as ballast. The pebbles and the metal weights 62, 64 at the front portion of the container together are ballast that is biased in weight towards the front of the container because the metal weights have a greater density than the pebbles. It is to be noted however that because of the above mentioned flat portion of the convex bottom of the container the base 16 sits substantially upright when the base cushion member has not yet been attached to the container. FIG. 17 is a side view of the base 16 showing a spring detached 46 from the base. As discussed above the spring 46 extends forward from a front surface 54 of the container and is used to reinforce a leg portion of the base cushion member. A threaded stud 74 is welded to a metal weight 62, 64 that is part of the ballast and extends forward from a flat surface 54 at the front of the container. In a prototype the coil spring has a length of about six inches, with an outside diameter of about one and a half inches, an inside diameter of about one and a quarter inches, and has about five coils per inch of length of the spring with the coils being substantially in contact with one another when the spring is not being bent or stretched. The coil spring is twisted onto the threaded stud 74. This construction applies to both of the coil springs 46, 48 that extend forward from the container.

Figure 18:
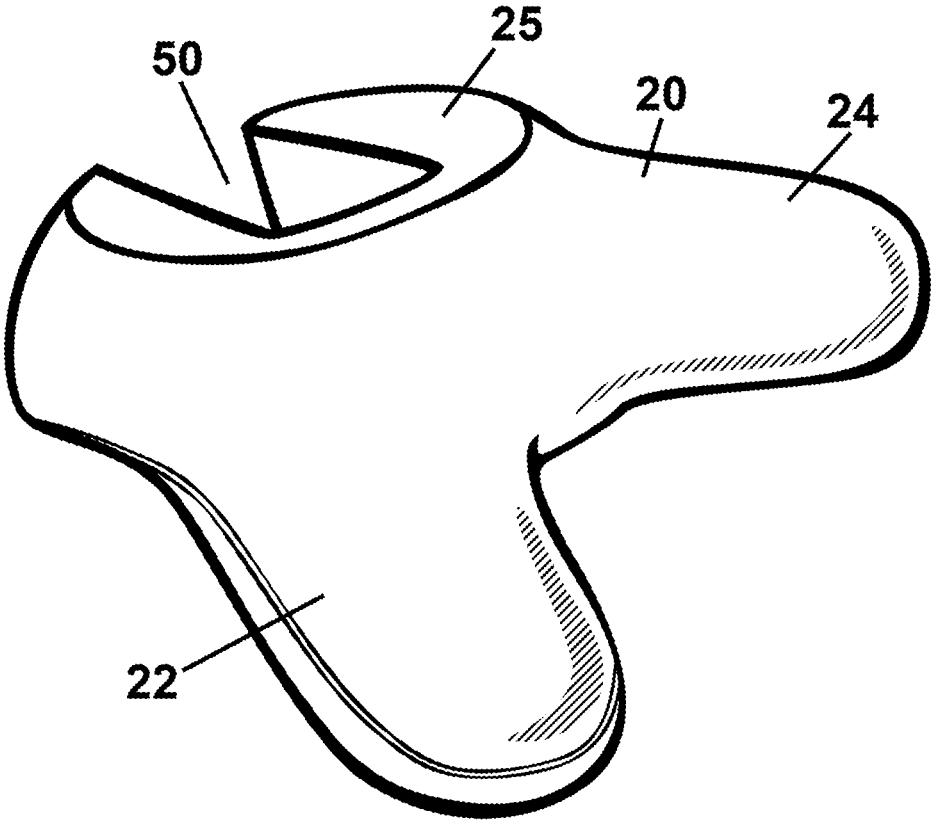
FIG. 18 is a perspective view showing the top of a base cushion that is a component of the base assembly.
Figure 19:
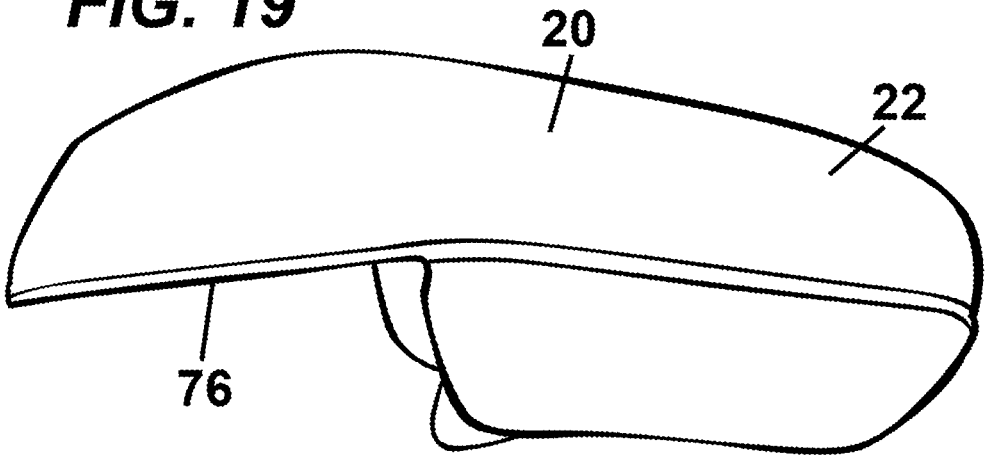
FIG. 19 is a side view of the base cushion.
Figure 20:
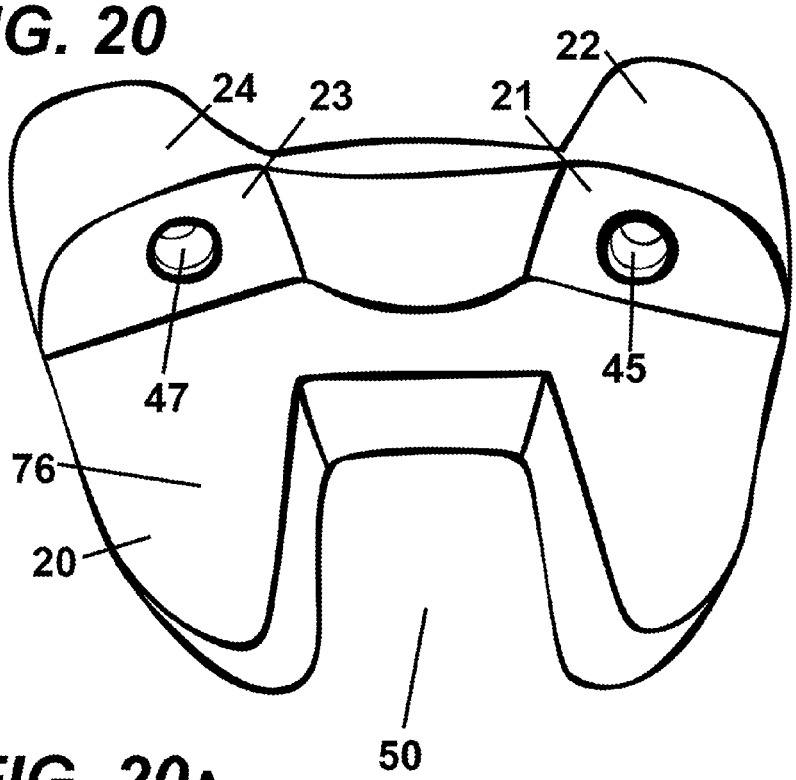
FIG. 20 is a perspective view showing the bottom of the base cushion.
Figure 20A:
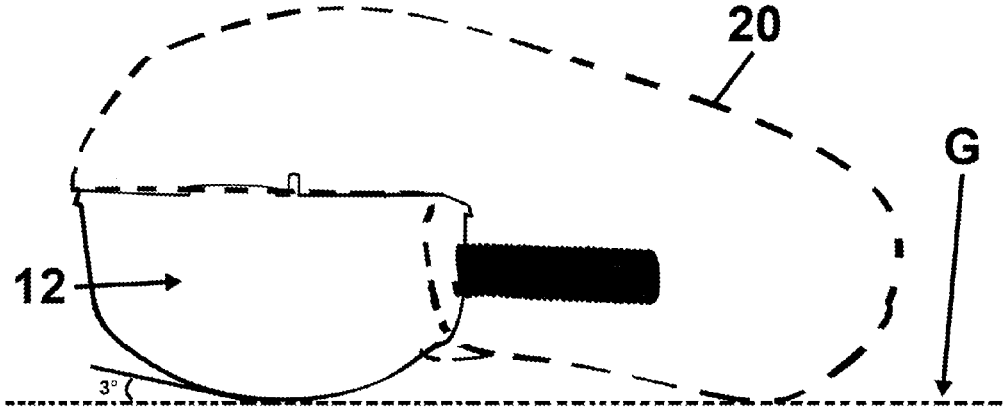
FIG. 20A is a side view of the base with the base cushion shown in phantom.
Figure 27:
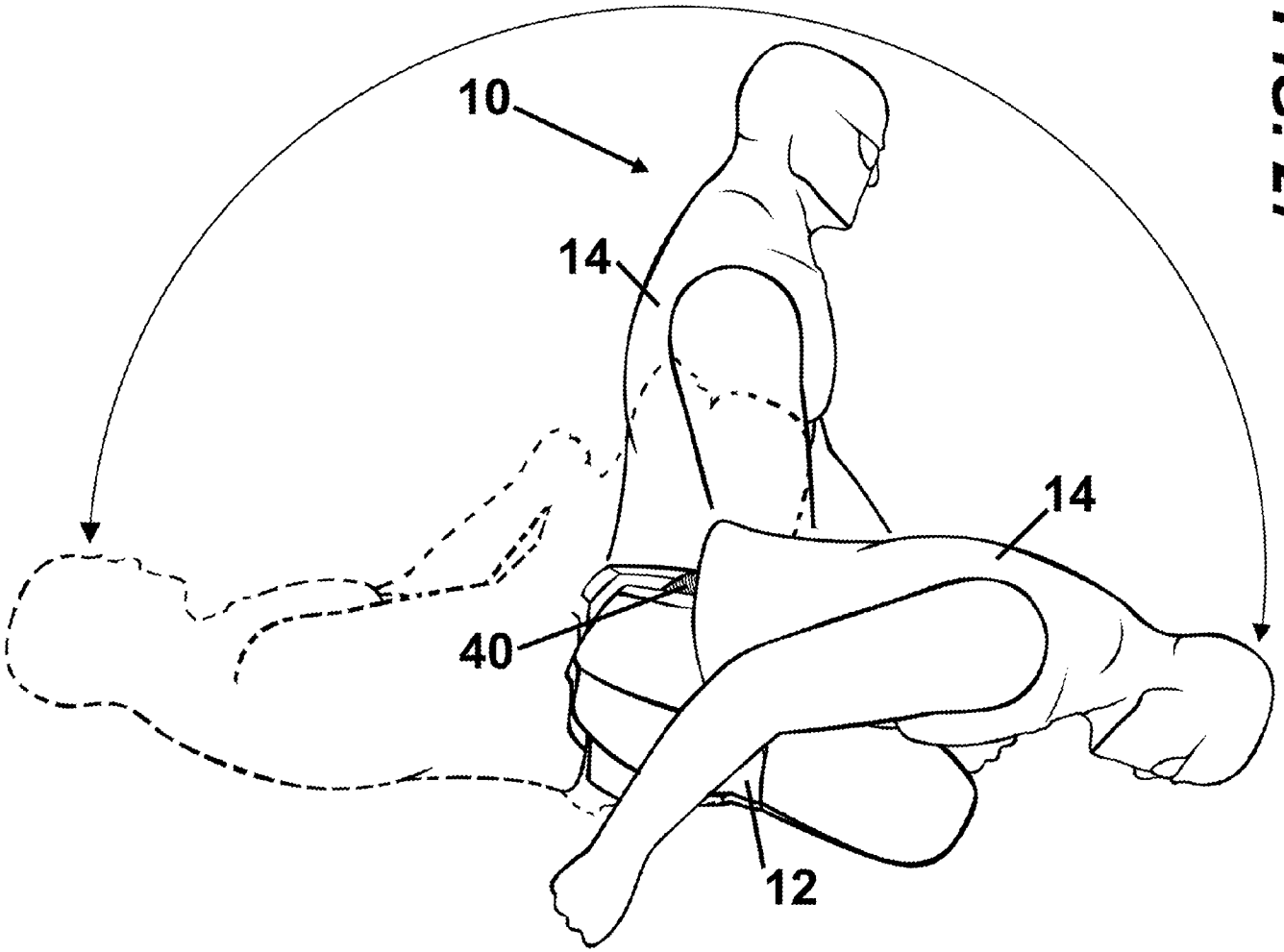
FIG. 27 is a schematic representation of a range of motion of the martial arts training device in forward and rearward directions.

FIG. 18 is a perspective view showing the top of the base cushion 20 that is a component of the base assembly 16; FIG. 19 is a side view of the base cushion; and FIG. 20 is a perspective view showing the bottom of the base cushion. The base cushion is made of a urethane foam. The base cushion has a pair of leg portions 22, 24. The base cushion has a notch 50 in a back portion of the base cushion that leaves the mounting fixture of the base portion exposed when a bottom surface 70 of the base cushion is placed adjacent the cover of the base. The base cushion member is fixed to the cover of the base using a suitable adhesive. Each leg portion 22, 24 presents a wall 21, 23 that is adjacent one of the forward facing walls 52, 54 of the container when the base cushion member. FIG. 20A is a side view of the base assembly 12 with the base cushion member 20 shown in phantom. The position of one of the springs 46, 48 in one of the wells 45, 47 one of the leg portions 22, 24 of the base cushion member is indicated in FIG. 20A. The at least one ballast component inside the container in conjunction with and the leg portions of the base cushion member causing a rear portion of the base assembly to be elevated when the martial arts training device is at rest in an upright state. In FIG. 20A the extent of the elevation of the rear portion of the base assembly is about three degrees. The forward leaning feature of the base assembly is also illustrated in FIG. 2. It is to be further noted that the weight of the base assembly is preferably greater than the weight of the torso assembly. Put another way, the at least one ballast component inside the container in conjunction with the leg portions of the base cushion member causing the base assembly to tilt forward when the martial arts training device is at rest in an upright state. Referring to FIG. 27 which is a schematic representation of a range of motion of the martial arts training device in forward and rearward directions, the forward tilt of the base assembly causes the martial arts training device 10 return spontaneously return to an upright state even if the entire device is displace backwards or forwards as shown in FIG. 27. This phenomena exhibited by the martial arts training device of the present invention facilitates an improved experience for a person using the device to train for MMA.

Figure 21:
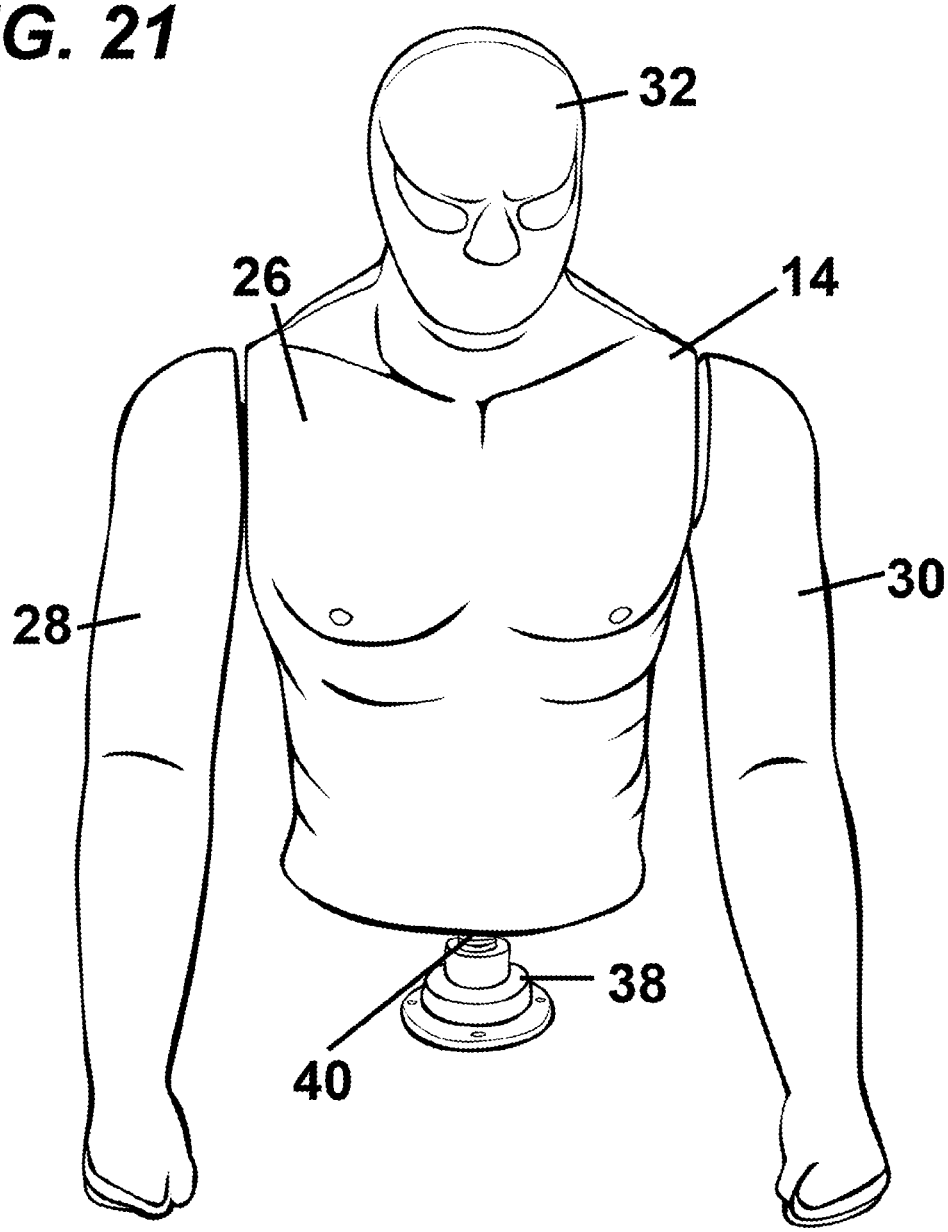
FIG. 21 is a pictorial view of a torso assembly of the martial arts training device of FIG. 1.
Figure 22:
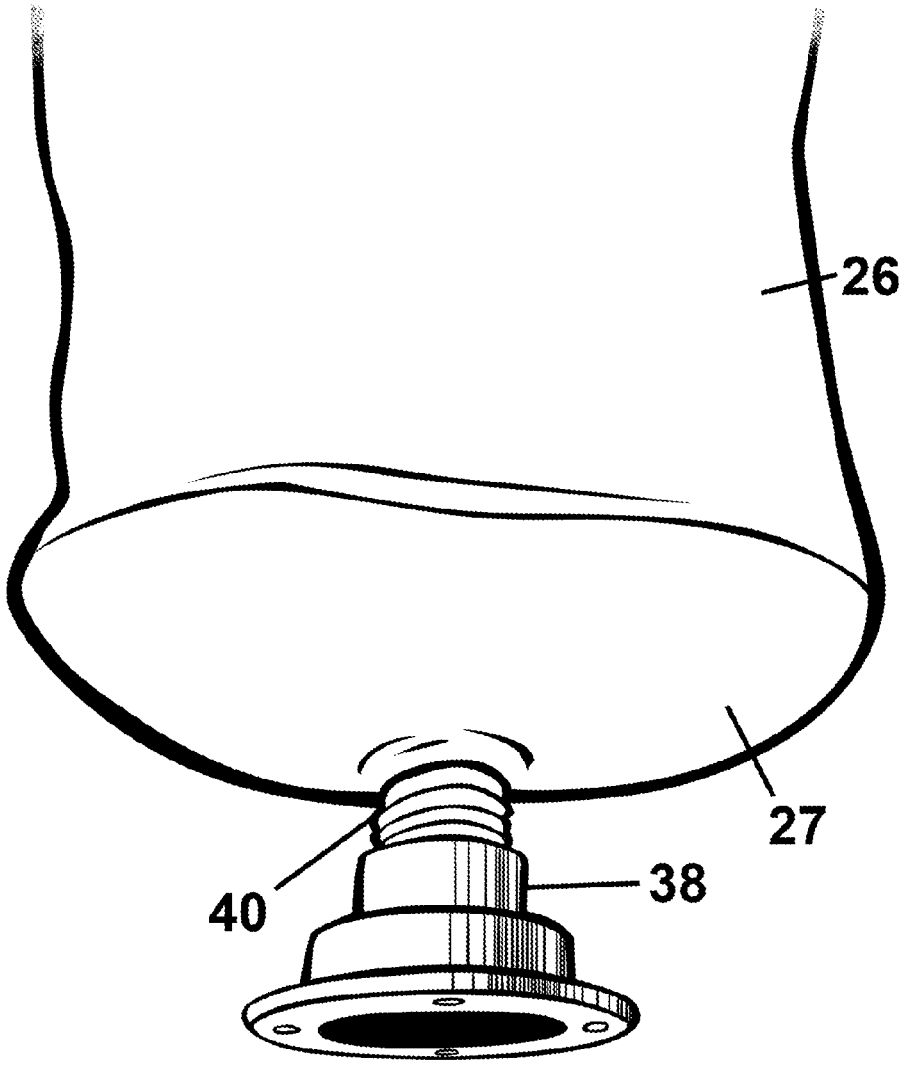
FIG. 22 is a fragmentary view of the torso assembly showing a lowermost portion of the torso assembly.

FIG. 21 is a pictorial view of the torso assembly 14 of the martial arts training device of the present invention. The torso assembly includes a torso 26 comprising urethane foam that is reinforced with reinforcing members that will be described later. Two arms 28, 30 are fixed to the torso in a manner that allows the arms to pivot with respect to the torso. Each arm comprises urethane foam that is reinforced with reinforcing members that will be described later. A head 32 that emulates a human head is located the top of the torso. FIG. 22 shows a lowermost portion of the torso assembly. In FIGS. 21 and 22 it can be seen that a extending from a lower surface 27 of the torso is a device 40 that allows the torso assembly to be pivoted with respect to the base assembly. A mounting fixture 38 is fixed to the device that allows the torso assembly to be pivoted with respect to the base assembly. As used herein and in the claims the term "pivoted" is understood to have its common meaning of changing orientation or direction. In a prototype the device that allows the torso assembly to be pivoted with respect to the base assembly is a coil spring 40.

Figure 23:
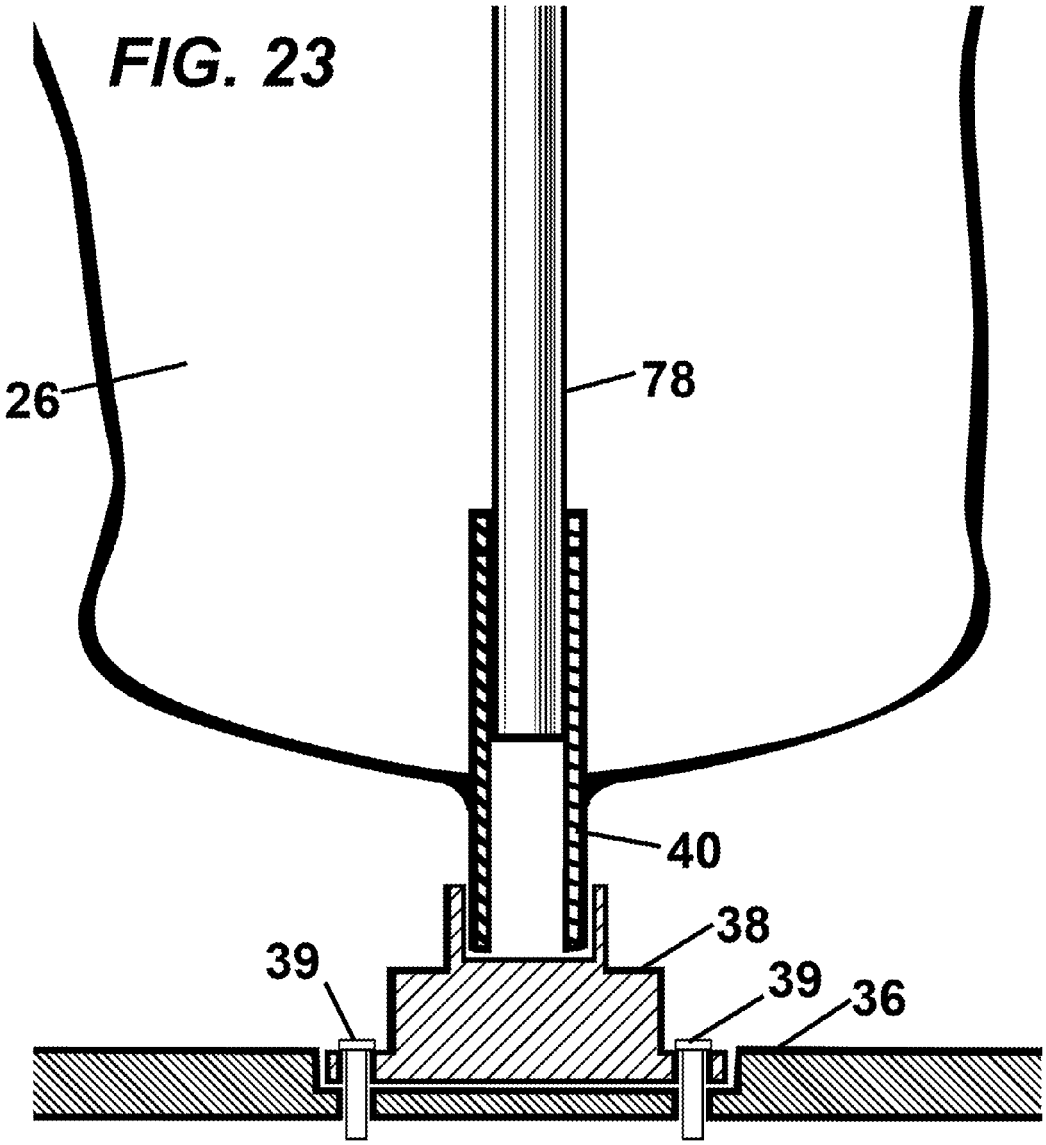
FIG. 23 is a schematic section view showing the attachment of the torso assembly to the base assembly.

Referring next to FIG. 23 there is shown a schematic section view showing the attachment of the torso assembly to the base assembly. A first torso reinforcing member 78 is embedded in urethane foam and extends substantially vertically when the martial arts training device is at rest in an upright state as shown in FIGS. 1-3. In a prototype the first torso reinforcing member was PVC pipe having an outside diameter of about one and three quarter inches. All of the torso and arm reinforcing members are embedded in urethane foam during a molding process. The urethane foam should have a density that is great enough allow the arms and torso to emulate the feel of a human body while at the same time minimizing the weight of the arms and torso to contribute to the rebound property of the training device when the entire training device is displaced forwards or backwards during an MMA training activity. The rebound characteristic of a martial arts training device of the present invention presents some resistance to the person practicing MMA to present a more realistic feel of encountering a human opponent. As already stated it is desirable to have the torso assembly weigh less, for example around ten to twenty pounds, than the base assembly which weighs for example up to about eighty pounds when the container is filled with both the metal weights and pebbles as ballast components.

Figure 28:
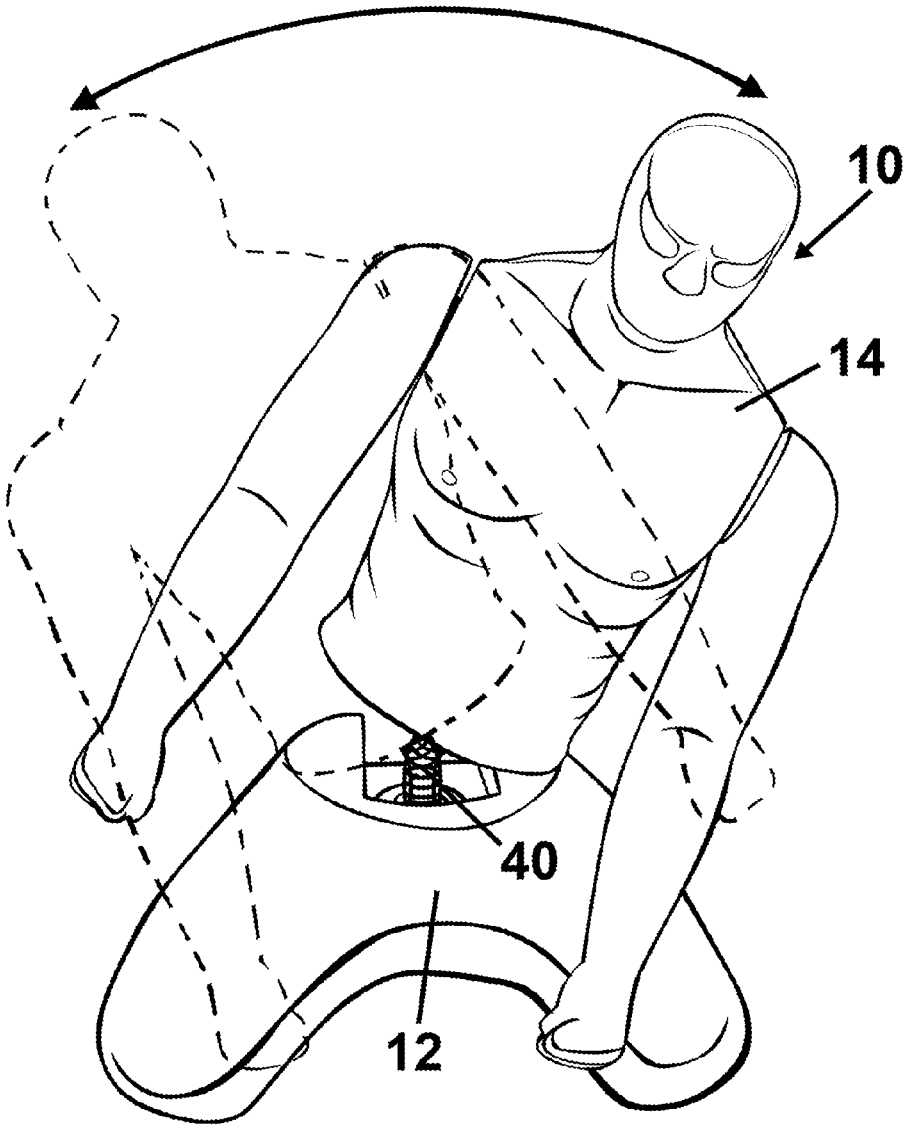
FIG. 28 is a schematic representation of a range of motion of the torso assembly of the martial arts training device in side to side directions with respect to the base assembly.
Figure 31:
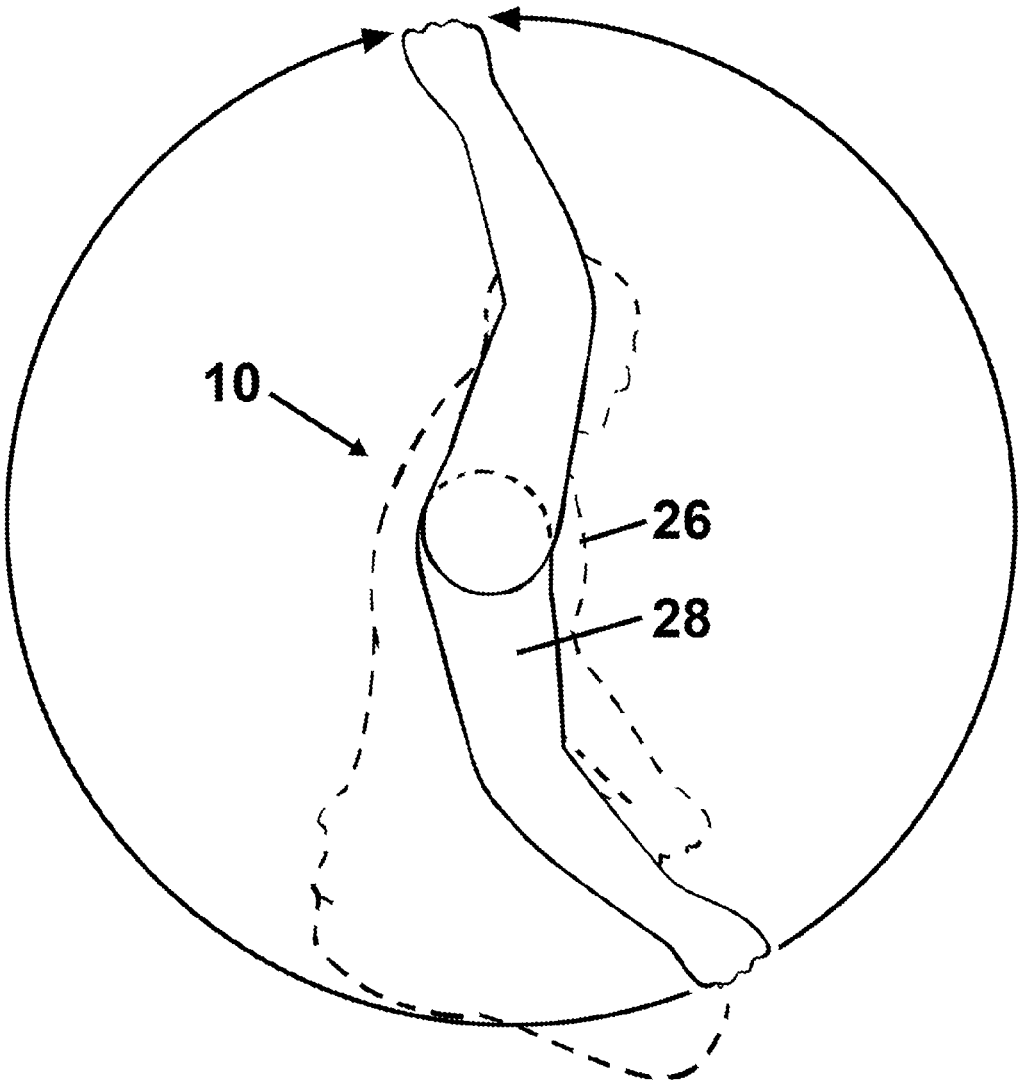
FIG. 31 is a schematic representation of a range of motion of forward elevation of the arms of the martial arts training device.

The coil spring 40 that functions as a device that allows the torso assembly to be pivoted with respect to the base assembly in a prototype is about eight inches long, has an outside diameter of about two inches, and, an inside diameter of about one and three quarter inches, and has about five coils per inch of length of the spring with the coils being substantially in contact with one another when the spring is not being bent or stretched. A portion of the first torso reinforcing member 78 is disposed within the spring. An upper portion of the spring 40 is embedded in the urethane that forms the torso. A mounting fixture 38 is fixed to the spring 40 by a lower portion of the spring being disposed in a well formed by an upper portion of the mounting fixture as shown in FIG. 23. The spring is secured to the mounting fixture in any suitable manner, such as an epoxy adhesive system. The mounting fixture 38 of the torso assembly is attached to the mounting fixture 36 of the base assembly using threaded fasteners 39 and the guide stud 70. The attachment of the torso assembly to the base assembly is shown also in FIG. 3. The disclosed attachment of the torso assembly to the base assembly allows the torso assembly 14 to pivot with respect to the base assembly 12 in a forward and rearward range of motion as illustrated in FIG. 27, and also in a side to side range of motion as illustrated in FIG. 28. A caveat is that to achieve optimal side to side motion of the torso assembly with respect to the base assembly a person practicing MMA must exert some downward force on the leg portions of the base assembly. It is of course understood that the device that allows the torso assembly to be pivoted with respect to the base assembly may be any appropriate component such as a ball and socket arrangement or a bendable solid bar that has a memory to return to a straight shape after being bent.

Figure 24:
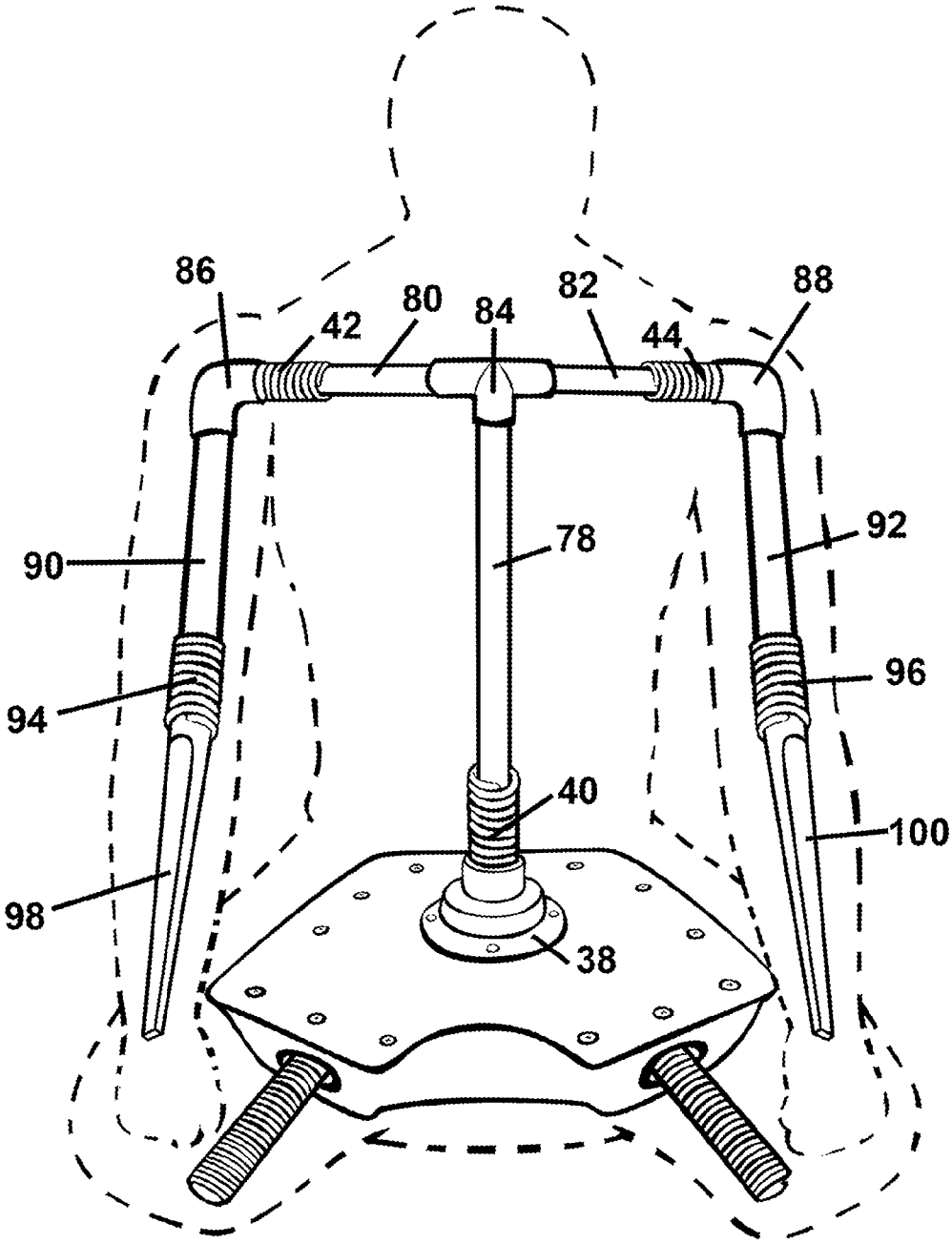
FIG. 24 is a schematic representation of the reinforcing members of the torso assembly which is attached to the base assembly, the foam structure of the torso assembly and base cushion being shown in phantom lines to represent the environment in which the reinforcing members reside.
Figure 25:
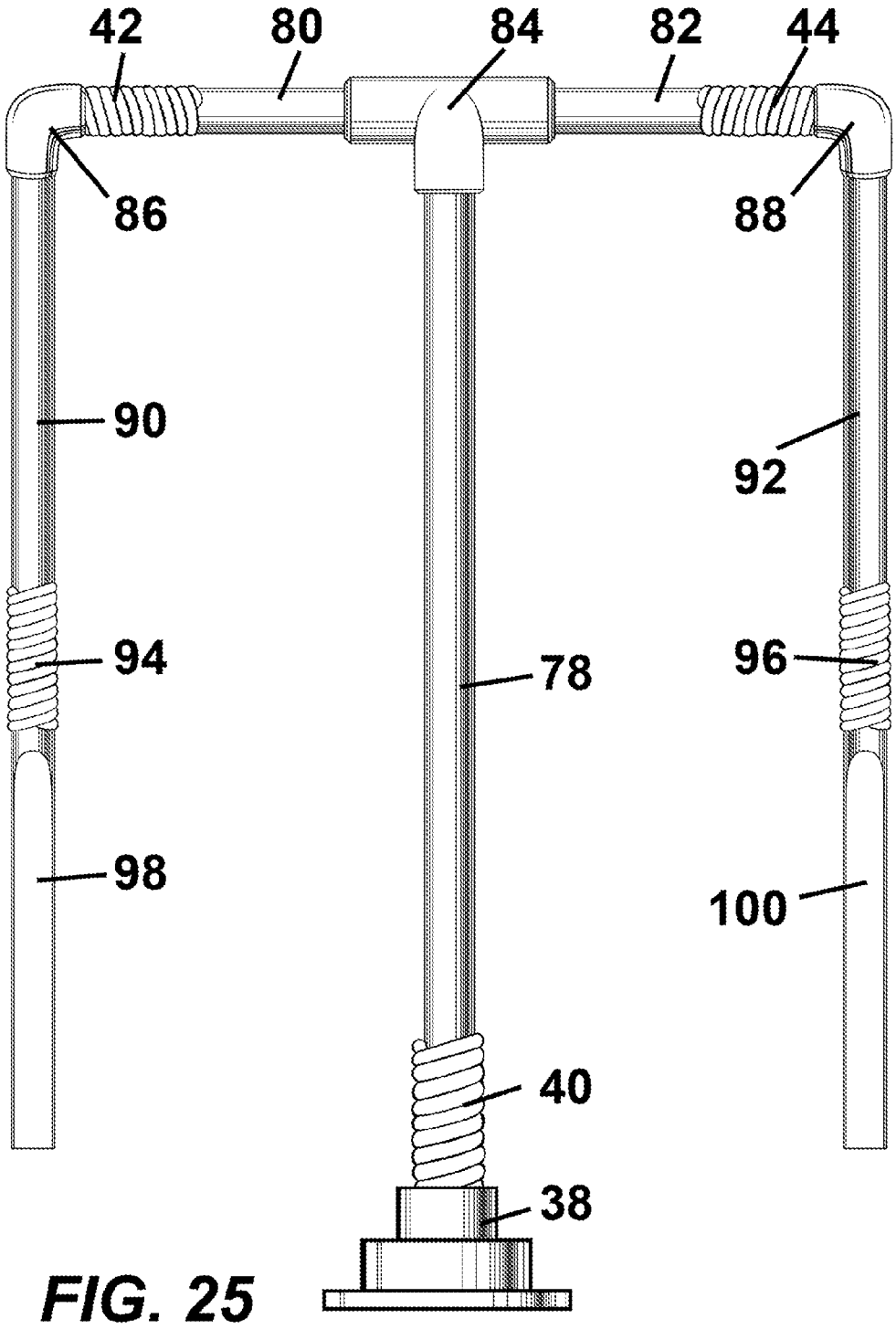
FIG. 25 is an enlarged schematic representation of the reinforcing members of the torso assembly.
Figure 26:
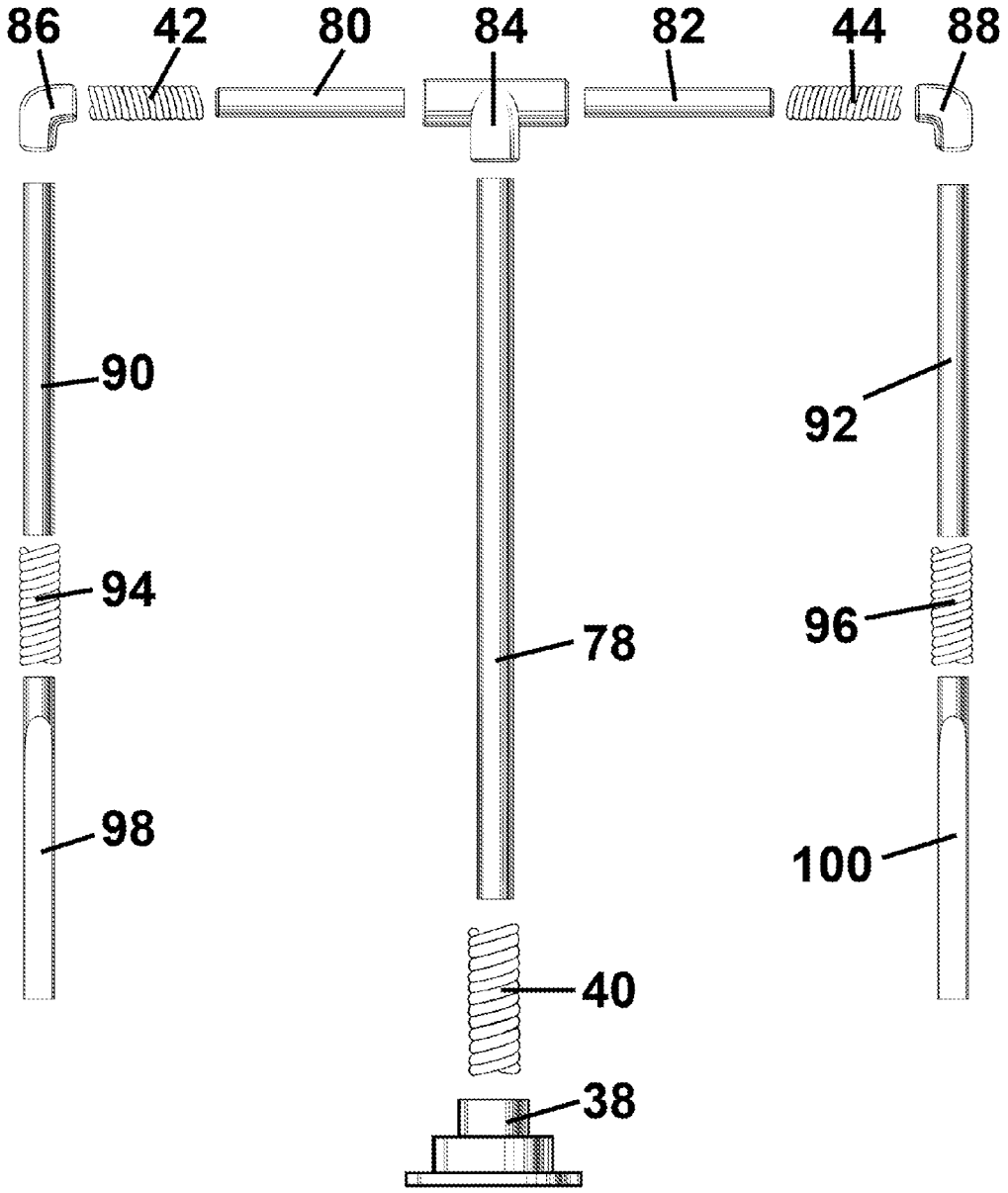
FIG. 26 is an exploded view of the reinforcing members of the torso assembly.

FIG. 24 is a schematic representation of the reinforcing members of the torso assembly which is shown attached to the base assembly, the foam structure of the torso assembly and base cushion member being shown in phantom lines to represent the environment in which the reinforcing members reside. FIG. 25 is an enlarged schematic representation of the reinforcing members of the torso assembly; and FIG. 26 is an exploded view of the reinforcing members of the torso assembly. In a prototype an upper region of the first torso reinforcing member 78 is fixed to at least one second torso reinforcing member 80, 82 that extends substantially perpendicular to the first torso reinforcing member. In the prototype the second torso reinforcing members comprise PVC pipe having an outside diameter of about one inch joined to the first torso reinforcing member by a PVC T coupling 84 wherein the base of the T has an inside diameter of about one and three quarter inches to receive the first torso reinforcing member and the arms of the T each have an inside diameter of about one inch to receive the second torso reinforcing members 82. It is of course understood that the torso reinforcing members may comprise any suitable materials and configurations including a specially fabricated single piece unit, and may comprise both solid and hollow members.

The martial arts training device preferably includes a pair if arms 28, 30 fixed to the torso. In a prototype each arm each formed of foam, preferably a urethane, and has first 90, 92 and second 98, 100 arm reinforcing members connected to one another and embedded in the foam. An end region of each of the first arm reinforcing members 90, 92 of each arm is fixed to an end region of a one second torso reinforcing member 80, 82 embedded in the foam of the torso by a device 42, 44 that allows the arm to be pivoted with respect to the torso. In a prototype the device that allows the arm to be pivoted with respect to the torso is a coil spring 42, 44 having first and second ends, the first end of the coil spring being fixed to an end region of a second torso reinforcing member 80, 82 and the second end of the coil spring being fixed to an end region of one of the first arm reinforcing members 90, 92. In the prototype the first arm reinforcing members was PVC pipe having an outside diameter of about one and three quarter inches, and a PVC elbow having an inside diameter of a size that operatively receives an end portion of the first arm reinforcing member is fixed to the first arm reinforcing member. In a prototype the coil springs 42, 44 have a length of about six inches, with an outside diameter of about one and a half inches, an inside diameter of about one and a quarter inches, and has about five coils per inch of length of the spring with the coils being substantially in contact with one another when the spring is not being bent or stretched. One end of each of the coil springs 42, 44 is disposed within the elbow 86, 88 and the other end of the same coil spring is receives into the interior of the spring an end portion of the associated second torso reinforcing member 80, 82. In this manner the arms are attached to the torso in a manner that allows the arms to pivot with respect to the torso as shown for example in FIGS. 29-31, 33 and 34 which illustrate ranges of motion of the arms 28, 30 with respect to the torso 26. It is of course understood that the device that allows an arm to be pivoted with respect to the torso may be any appropriate component such as a ball and socket arrangement or a bendable solid bar that has a memory to return to a straight shape after being bent.

Figure 32:
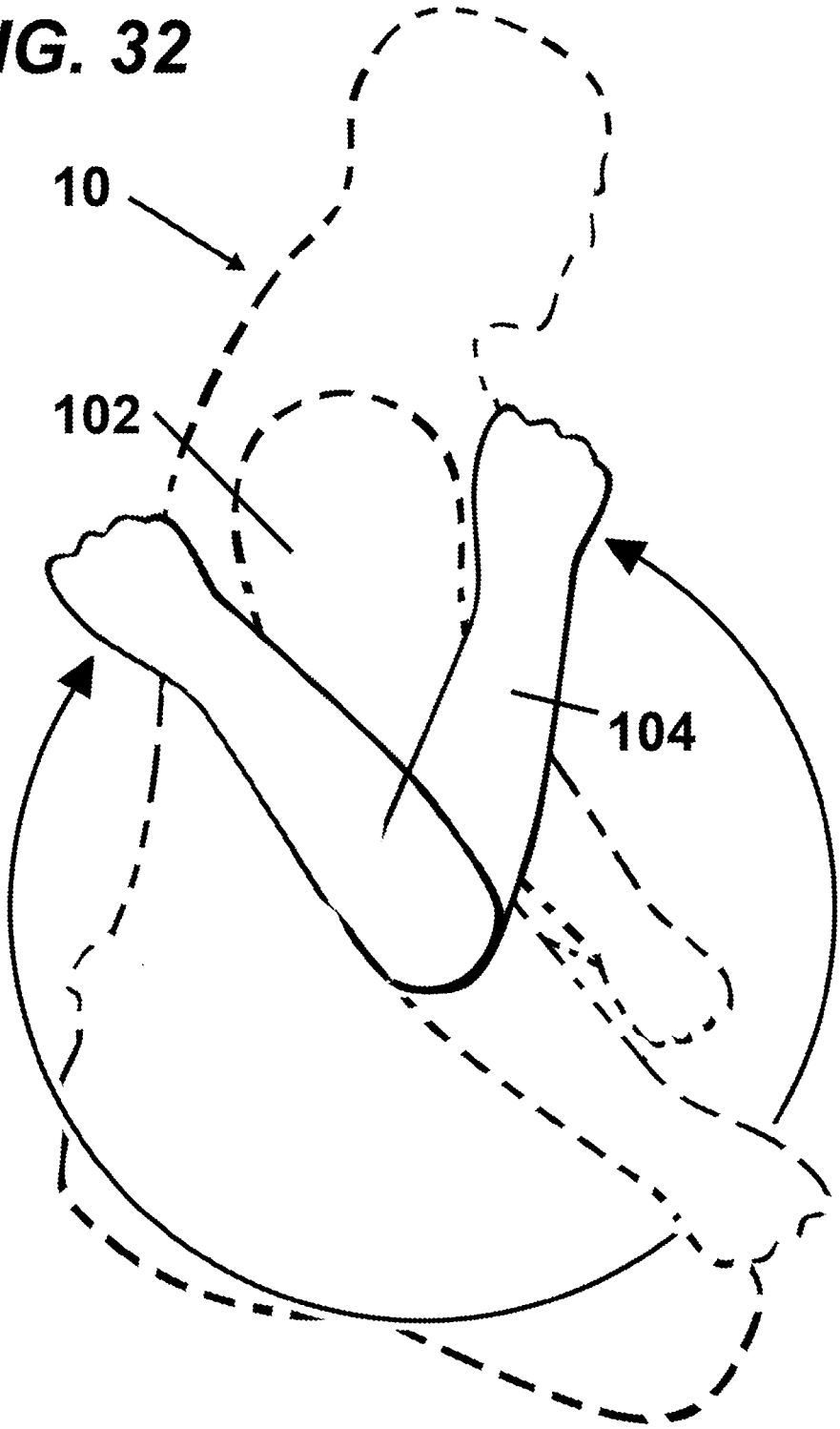
FIG. 32 is a schematic representation of a range of bending of an arm of the martial arts training device emulating the manner in which a human arm bends at an elbow.

In the prototype the second arm reinforcing members 98, 100 are PVC members having a first end that is round with an outside diameter of about one and three quarter inches and the majority of the length of the second arm reinforcing member being a solid member that tapers in width and thickness. The first 90, 92 and second 98, 100 arm reinforcing members are connected to one another by devices 94, 96 that allow the first and second arm reinforcing members to pivot with respect to one another. In the prototype the devices are coil springs 94, 96. In the prototype the coil springs 94, 96 have a length of about six inches, with an outside diameter of about one and a half inches, an inside diameter of about one and a quarter inches, and has about five coils per inch of length of the spring with the coils being substantially in contact with one another when the spring is not being bent or stretched. Each of the coil springs 94, 96 has first and seconds, the first end of the coil spring being fixed to an end region of the first arm reinforcing member and the second end of the coil spring being fixed to an end region of the second arm reinforcing member. In the prototype both the first and second arm reinforcing members are received inside the associated coil spring. The manner in which the first and second arm reinforcing members, and as a result the upper 102 and lower 104 portions of the arms 28, 30 pivot with respect to one another is illustrated in FIGS. 32-34. It is of course understood that the device that allows the lower arm to be pivoted with respect to the upper arm may be any appropriate component such as a ball and socket arrangement or a bendable solid bar that has a memory to return to a straight shape after being bent. It is of course understood that the arm reinforcing members may comprise any suitable materials and configurations including both solid and hollow members.

Referring next to FIGS. 1-3, 5 7 and 27 another feature of the martial arts training device can be understood. The torso assembly 14 is fixed to the base assembly 12 using the device 40 that allows the torso assembly to be pivoted with respect to the base assembly and the associated mounting fixtures. However, when the martial arts training device is in an upright position and emulates a sitting person the device, that is to say the spring 40, does not function as a sole support of the torso assembly. As best seen in FIG. 3, a rear view of the martial arts training device, at least a portion of the lower surface 27 of the torso 26 is adjacent to an upper surface 25 of the base cushion member 20, but the next adjacent surfaces are fixed in place by any adhesive. Inasmuch as the spring 40 is disposed within the notch 50 of the base cushion member the spring is not restrained from bending or stretching by the placement of the torso assembly on top of the base assembly while the entire martial arts training device 10 is stable while in an upright position emulating a sitting person.

It will be seen that the advantages set forth above, and those made apparent from the foregoing description, are efficiently attained and since certain changes may be made in the above construction without departing from the scope of the invention, it is intended that all matters contained in the foregoing description or shown in the accompanying drawings shall be interpreted as illustrative and not in a limiting sense. It is also to be understood that the following claims are intended to cover all of the generic and specific features of the invention herein described, and all statements of the scope of the invention which, as a matter of language, might be said to fall there between.

What is claimed is:

1. A martial arts training device comprising:

(a) a base assembly comprising a base and a base cushion member, the base having a container with a convex bottom, the container containing at least one ballast component, a cover is fixed to an upper portion of the container and a mounting fixture that is fixed to and located at the top of the base, the base cushion member is formed of a foam substance and is attached to the cover, the base cushion member includes leg portions that extend forward from the container, the mounting fixture remaining exposed and not covered by the base cushion member, the at least one ballast component inside the container in conjunction with the leg portions of the base cushion member causing the base assembly to tilt forward when the martial arts training device is at rest in an upright state; and (b) a torso assembly, the torso assembly including a torso that is formed of a foam substance and a device that allows the torso assembly to be pivoted with respect to the base assembly, a mounting fixture is fixed to the device that allows the torso assembly to be pivoted with respect to the base assembly, and the mounting fixture of the torso assembly is attached to the mounting fixture of the base assembly.

2. The martial arts training device of claim 1 wherein the torso assembly further comprises a pair of arms fixed to the torso, each arm being formed of a foam substance.

3. The martial arts training device of claim 1 wherein the torso assembly further comprises torso reinforcing members connected to one another and embedded in the foam of the torso.

4. The martial arts training device of claim 3 wherein the torso assembly further comprises a pair of arms fixed to the torso, each arm being formed of a foam substance and having arm reinforcing members connected to one another and embedded in the foam substance.

5. The martial arts training device of claim 4 wherein one of the arm reinforcing members of each arm is fixed to one of the torso reinforcing members of the torso by a device that allows the arm to be pivoted with respect to the torso.

6. The martial arts training device of claim 5 wherein two arm reinforcing members are disposed in each arm with the arm reinforcing members fixed to one another by a device that allows the arm reinforcing members to pivot with respect to one another.

7. The martial arts training device of claim 1 further wherein each of the leg portions of the base cushion member of the base assembly is provided with a well that receives a device that extends from the container and allows the leg portions of the base cushion member to pivot with respect to a main body portion of the base cushion member.

8. The martial arts training device of claim 1 wherein the torso includes a head that emulates a human head located the top of the torso.

9. The martial arts training device of claim 3 wherein the device that is fixed to the mounting fixture that allows the torso assembly to be pivoted with respect to the base assembly is a coil spring having spaced apart ends, one end of the coil spring being fixed to the mounting fixture of the torso assembly and the other end of the coil spring being fixed to a lower region of a first torso reinforcing member, said first torso reinforcing member extending substantially vertically when the martial arts training device is at rest in an upright state.

10. The martial arts training device of claim 9 wherein an upper region of the first torso reinforcing member is fixed to at least one second torso reinforcing member that extends substantially perpendicular to the first torso reinforcing member.

11. The martial arts training device of claim 9 wherein the torso assembly further comprises a pair of arms fixed to the torso, each arm being formed of a foam substance and having first and second arm reinforcing members connected to one another and embedded in the foam substance, wherein an end region of one of the arm reinforcing members of each arm is fixed to an end region of the at least one second torso reinforcing member embedded in the foam of the torso by a device that allows the arm to be pivoted with respect to the torso.

12. The martial arts training device of claim 11 wherein the device that allows the arm to be pivoted with respect to the torso is a coil spring having first and second ends, the first end of the coil spring being fixed to an end region of the at least one second torso reinforcing member and the second end of the coil spring being fixed to an end region of one of the arm reinforcing members.

13. The martial arts training device of claim 11 wherein the first and second arm reinforcing members are connected to one another by a device that allows the first and second arm reinforcing members to pivot with respect to one another, said device being a coil spring having first and seconds, the first end of the coil spring being fixed to an end region of the first arm reinforcing member and the second end of the coil spring being fixed to an end region of the second arm reinforcing member.

14. A martial arts training device in the form of a grappling dummy comprising a base assembly comprising a base and a base cushion member, the base having a container with a convex bottom and a cover fixed to an upper portion of the container with a mounting fixture fixed to and located at the to of the base, the container containing at least one ballast component and the base cushion member is attached to the cover, the base cushion member including leg portions that extend forward from the container; the base assembly being joined to a torso assembly, the torso assembly including a torso and a mounting fixture that is fixed to a device that allows the torso assembly to pivot with respect to the base assembly, the mounting fixture of the torso assembly is attached to the mounting fixture of the base assembly and the base assembly tilts forward when the martial arts training device is in an upright position such that when the entire martial arts training device is caused to recline backwards the device will return to the upright position spontaneously.

15. The martial arts training device in the form of a grappling dummy according to claim 14 wherein the torso assembly includes two arms fixed to the torso, each arm being fixed to the torso by a device that allows the arm to pivot with respect to the torso.

16. The martial arts training device in the form of a grappling dummy according to claim 15 wherein each of the arms has an upper arm portion and a lower arm portion, wherein the lower arm portion is fixed to the upper arm portion by a device that allows the lower arm portion to pivot with respect to the upper arm portion.

17. The martial arts training device in the form of a grappling dummy according to claim 14 wherein the base assembly has a weight and the torso assembly has a weight, the weight of the base assembly being greater than the weight of the torso assembly.

18. A grappling dummy comprising a base assembly that includes leg portions and a torso assembly fixed to the base assembly in a manner that allows the torso assembly to pivot with respect to the base assembly, the base assembly being heavier than the torso assembly, wherein the grappling dummy emulates a sitting person when the grappling dummy is sitting in an upright position, and the base assembly tilts forward when the grappling dummy is sitting in an upright position such that when the entire grappling dummy is caused to recline backwards the grappling dummy will return to the upright position spontaneously; the base assembly comprising a base and a base cushion member, the base having a container with a convex bottom and a cover fixed to an upper portion of the container with a mounting fixture fixed to and located at the top of the base, the container containing at least one ballast component and the base cushion member is attached to the cover, the base cushion member including leg portions that extend forward from the container; the torso assembly including a torso and a mounting fixture that is fixed to a device that allows the torso assembly to pivot with respect to the base assembly and the mounting fixture of the torso assembly is attached to the mounting fixture of the base assembly.

19. The grappling dummy of claim 18 wherein the torso assembly includes two arms fixed to the torso, each arm being fixed to the torso by a device that allows the arm to pivot with respect to the torso, and each of the arms has an upper arm portion and a lower arm portion, wherein the lower arm portion is fixed to the upper arm portion by a device that allows the lower arm portion to pivot with respect to the upper arm portion.

20. The grappling dummy of claim 18 wherein the device that allows the torso assembly to pivot with respect to the base assembly comprises a coil spring having a first end that is fixed to the torso assembly and a second end that is fixed to the mounting fixture of the torso assembly, and at least a portion of a lower surface of the torso is adjacent to an upper surface of the base cushion member when the grappling dummy is sitting in an upright position.

* * * * *